US006945631B2

(12) United States Patent
Adachi

(10) Patent No.: US 6,945,631 B2
(45) Date of Patent: Sep. 20, 2005

(54) IMAGE FORMING METHOD AND APPARATUS

(75) Inventor: Keiichi Adachi, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 97 days.

(21) Appl. No.: 10/219,754

(22) Filed: Aug. 16, 2002

(65) Prior Publication Data

US 2003/0063179 A1 Apr. 3, 2003

(30) Foreign Application Priority Data

Aug. 17, 2001 (JP) ..... P.2001-248075
Sep. 6, 2001 (JP) ..... P.2001-270421
Sep. 6, 2001 (JP) ..... P.2001-270422

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 6,557,979 B2 * 5/2003 Ohsawa et al. ..... 347/55

FOREIGN PATENT DOCUMENTS

| | | |
|---|---|---|
| EP | 0 988 968 A1 | 3/2000 |
| GB | 2 351 699 A | 1/2001 |
| JP | 64-27953 | 1/1989 |
| JP | 4-97848 | 3/1992 |
| JP | 10-286939 | 10/1998 |

* cited by examiner

*Primary Examiner*—Raquel Yvette Gordon
(74) *Attorney, Agent, or Firm*—Sughrue Mion, PLLC

(57) ABSTRACT

An image forming method comprising steps of: preparing a medium to be formed an image thereon, the image being based on signals of image data; forming the image directly on the medium in an ink jet system that discharges oil-based ink by utilizing electrostatic fields; rolling an adhesive roller on the medium before and/or during forming the image on the medium; adhering dust existing on the medium to the adhesive roller in order to remove the dust from the medium; and, fixing the image on the medium.

14 Claims, 10 Drawing Sheets

IMAGE FORMING METHOD AND APPARATUS

BACKGROUND OF THE INVENTION

The present invention relates to a printing method for forming a printing image directly on a printing medium, and in detail an ink jet printing method which, by adsorbing dust and foreign matter existing on a printing medium and removing the same therefrom, is able to bring about a sophisticated printing image by electrostatic type ink jet recording and is able to print at a high speed.

An electro-photographic system, a sublimation type and fusion type thermal transfer system, and an ink jet system, etc., are available as a printing method for forming a printing image on a printing medium on the basis of image data signals.

The electro-photographic system becomes an expensive apparatus whose system requires a process for forming an electrostatic latent image by electric charge and exposure on a photosensitive drum and becomes complicated.

The thermal transfer system is inexpensive as an apparatus, but since an ink ribbon is used, running cost thereof becomes high, and waste is produced.

On the other hand, the ink jet system is inexpensive as an apparatus, and since ink is discharged onto only an image portion required and direct printing is carried out on a printing medium, coloring agents can be efficiently used, and the running cost thereof is inexpensive.

A method for attaching an ink jet printing press to a web press and additionally printing varying numbers and marks, etc., on the same paper by the ink jet system is disclosed in, for example, Japanese Unexamined Patent Publication No. 10-286939, as a method for applying an ink jet technology to a printing system.

However, it is further preferable that high-quality image information such as a photo image can be printed. But, with an ink technology in which water-based or organic solvent-based ink containing prior art dyes or pigments as coloring agents is jetted under pressure, since liquid drops containing a great deal of solvent are discharged, there is a shortcoming in that blur occurs in a printed image unless expensive exclusive paper is used.

Therefore, where printing is carried out on normal paper or plastic sheets which are a non-absorptive medium, etc., no high-quality printed image can be obtained.

Also, as one of the ink jet technologies, there is a method for heating and fusing ink, which is solid at a normal temperature, and jetting fused ink to form an image. If this ink is used, blur of a printed image can be relieved. However, since the ink viscosity is still high when the ink is discharged, it is difficult to jet very fine liquid drops, wherein individual dot images obtained will have large areas and be thick, and accordingly, no fine image can be formed.

Further, in order to obtain high-quality images, it is necessary to keep the discharging state of an ink jet in good condition. However, dust and/or foreign matter adhered to a printing medium are adhered to a printing head and deposited there in line with use of the recording head, wherein if the recording head may stop or malfunction, there is a fear that the printed matter willing stained. That is, clear images are scarcely obtained.

The present invention also relates to a plate making method and plate making apparatus, which carry out making of a digital plate, and in particular a plate making method and a plate making apparatus, which bring about satisfactory plate quality and printing quality using oil-based ink.

The present invention relates to an in-press image plotting and offset printing method and an in-press image plotting and offset printing press in which digital plate making is carried out in a press. In further detail, the invention relates to a plate-making and printing method and a printing press that carries out printing upon performing plate making by oil-based ink and is able to bring about satisfactory plate making quality and satisfactory printing quality.

In offset printing, areas for receiving printing ink and those for repulsing printing ink are provided on the surface of a printing plate in compliance with an image document, and printing ink is adhered to the areas for receiving ink to carry out printing. Normally, hydrophilic and lipophilic (ink-receptivity) areas are formed on the surface of a plate as per images, the hydrophilic areas are made into an ink repulsing property, using dampening water.

With respect to recording (plating making) images on a printing master plate, generally, once an image document is analogically or digitally outputted on a silver salt photography film, a diazo resin and optically polymerizable photopolymer sensitive material (printing master plate) is exposed to light through the silver salt photography film, and non-imaging portions are eluted and removed mainly by an alkali-based solution.

Recently, in offset printing, in view of recent advancements in digital image plotting technologies and requests for an increase in processing efficiency, many systems for directly plotting digital image information have been proposed. This technology is called "CTP" (Computer-to-plate) or "DDPP" (Digital Direct Printing Plate). A system for recording images in an optical mode or a thermal mode by using, for example, a laser beam is available, and the system has been partially made into practical application.

However, the plate making system is such that in both the optical mode and thermal mode, treatment is made with an alkali developing solution after recording by a laser, and non-imaged portions are eluted and removed to make printing plates, wherein the alkali solution is discharged as a waste solution, and this is not favorable in view of the environment.

On the other hand, since, with a method using a laser beam, the apparatus becomes expensive and large-scaled, a system using an ink jet method by which an inexpensive and compact image plotting apparatus can be brought about has been attempted.

Japanese Unexamined Patent Application Publication No. 64-27953 discloses a method for making plates by plotting images by an ink jet using lipophilic wax ink on a hydrophilic plate material. With this method, a mechanical strength of image-plotted portions is weak because the images are formed of wax, and adhesivity with the hydrophilic surface of plates shortens, wherein print resistance thereof is low.

Further, it is necessary to maintain the discharge state of an ink jet in good conditions in order to obtain high quality images. That is, since ink constituents are adhered to the head as the head is used, it is necessary to remove the adhered constituents. Conventionally, since head cleaning is carried out when an appointed duration of time elapses or when the image quality is lowered, there are many cases where plates are made with the head becoming dirty. Also, there are many cases where, since the ink constituents are fixed and hardened as regards some ink constituents, it is difficult to remove the ink constituents by normal cleaning unit. In these cases, head stains cannot be removed, wherein cleaning should be frequently carried out, and stains that cannot be removed are deposited, thereby causing the head to quickly become worn.

Further, a system for plotting images in a press is available as unit for making a printing process efficient. Although a method using the above-described laser is available, the method becomes expensive, for which an apparatus is large-sized. Therefore, an attempt has been made to apply a system in which an ink jet system being an inexpensive and compact image plotting unit is employed.

Japanese Patent Application Publication No. 4-97848 discloses a method, in which a plate drum whose surface portion is hydrophilic and lipophilic is employed instead of a prior art plate cylinder, lipophilic and hydrophilic images are formed thereon by an ink jet method and the images are eliminated and cleaned after the printing is completed. However, with this method, removal (easiness of cleaning) of printing images is not compatible with a print resistance property. Also, if an attempt is made to form printing images having a high print resistance property on a plate cylinder, it is necessary to use ink containing resin of comparatively high concentration. Therefore, in ink jetting unit for forming printing images, resin is likely to be fixed at and adhered to a nozzle portion due to evaporation of a solvent, wherein stability of ink discharge is lowered. As a result, it becomes difficult for satisfactory images to be brought about.

SUMMARY OF THE INVENTION

The invention was developed in view of the above-described problems and shortcomings, and it is therefore a first object of the invention to provide an ink jet printing method that is able to bring about printed matter of high-quality and clear images by an inexpensive apparatus and a simple method, and, in particular, an ink jet printing method that is able to bring about printed matter of ever-clear and high-quality images by removing dust and foreign matter from a printing medium, which is used for printing, by an inexpensive and a simple method.

The present invention was developed in view of the above-described problems. It is therefore a second object of the invention to provide a plate making method and a plate making apparatus to match digital specifications, which does not require any developing process, and to provide a plate making method and a plate making apparatus, which are able to form high quality images on a plate material by removing dust and foreign matter existing on the plate material by an inexpensive and simple method.

The present invention was developed in view of the above-described and other problems. It is therefore a third object of the present invention to provide an in-press image plotting and offset printing method and in-press image plotting and offset printing press, which are applicable to digital specifications not requiring any developing process. It is a fourth object thereof to provide an in-press image plotting and offset printing method and in-press image plotting and offset printing press, which are able to print a number of clear printed matter having high-quality images by an inexpensive apparatus and a simple method by removing dust and foreign matter existing on a plate material.

In order to achieve the first object, an image forming method according to the first aspect of the invention is featured in that an image forming method comprising steps of: preparing a medium to be formed an image thereon, the image being based on signals of image data; forming the image directly on the medium in an ink jet system that discharges oil-based ink by utilizing electrostatic fields; rolling an adhesive roller on the medium before and/or during forming the image on the medium; adhering dust existing on the medium to the adhesive roller in order to remove the dust from the medium; and, fixing the image on the medium.

Also, the image forming method according to a second aspect of the invention is featured in that the image forming method as set forth in the first aspect of the present invention, wherein an adhesive force of the adhesive roller is 4 hPa or more and 250 hPa or less.

Also, an ink jet printing method according to a third aspect of the invention is featured in that an ink jet printing method to which the image forming method as set forth in the first or second aspect is applied, wherein the medium is a printing medium and a printed matter is created by forming and fixing the image directly on the printing medium.

Also, a plate making method according to a fourth aspect of the invention is featured in that a plate making method to which the image forming method as set forth in the first or second aspect is applied, wherein the medium is a plate material and a plate is created by forming and fixing the image directly on the plate material.

Also, an in-press image plotting and offset printing method according to a fifth aspect of the invention is featured in that an in-press image plotting and offset printing method to which the plate making method as set forth in the fourth aspect is applied, further comprising steps of: attaching the plate material onto a plate cylinder of a press; and carrying out continuously offset printing by using the plate, wherein the step of attaching the plate material is carried out before the step of forming the image on the plate material and the step of offset printing is carried out after the fixing the image.

an image forming apparatus according to a sixth aspect of the invention is featured in that an image forming apparatus comprising: an image forming unit, for forming an image which is on the basis of image data directly on a medium, discharging oil-based ink by utilizing electrostatic fields in an ink jet image plotting; an image fixing unit fixing the image on the medium formed by the image forming unit; and an adhesive roller disposed so as to roll on the medium at an upstream of the image forming unit in a moving direction of the medium, wherein the adhesive roller adheres dust existing on the medium thereto in order to remove the dust from the medium.

The image forming apparatus according to a seventh aspect of the invention is featured in that the image forming apparatus as set forth in the six aspect, wherein an adhesive force of the adhesive roller is 4 hPa or more and 250 hPa or less.

The image forming apparatus according to an eighth aspect of the invention is featured in that the image forming apparatus asset forth in the sixth or seven aspect, wherein the adhesive roller includes at least two adhesive rollers whose adhesive forces are different from each other, one adhesive roller rolls on a medium, and simultaneously the other adhesive roller contacts with the one adhesive roller and has a larger adhesive force than that of the corresponding one adhesive roller.

An ink jet printing apparatus according to a ninth aspect of the invention is featured in that an ink jet printing apparatus to which the image forming apparatus as set forth in any one of the sixth to eighth aspects is applied, wherein the medium is a printing medium and a printed matter is created by forming the image directly on the printing medium.

A plate making apparatus according to a tenth aspect of the invention is featured in that a plate making apparatus to which the image forming apparatus as set forth in any one of the sixth to eighth aspects is applied, wherein the medium is a plate material and a plate is created by forming the image directly on the plate material.

An in-press image plotting and offset printing apparatus according to an eleventh aspect of the invention is featured in that an in-press image plotting and offset printing apparatus to which the plate making apparatus as set forth in the tenth aspect is applied, further comprising: a plate cylinder of a press attached a plate material thereon; wherein offset printing is carried out continuously by using the plate.

An in-press image plotting and offset printing apparatus according to a twelfth aspect of the invention is featured in that an in-press image plotting and offset printing apparatus as set forth in the eleventh aspect, further comprising: a press roller disposed at the downstream of the image forming unit in a moving direction of the plate material in a state of either one of a pressed state or a non-pressed state with respect to the plate cylinder, wherein the press roller has the adhesive forces.

In the above-described composition, it is preferable that the above-described oil-based ink has hydrophobic resin droplets, which are solid at least at normal temperatures, dispersed in a non-aqueous solvent whose inherent electric resistance is $10^9$ Ωcm or more and dielectric constant is 3.5 or less.

Further, in the above-described composition, it is preferable that the oil-based ink is discharged from a recording head (a printing head, a recording head).

In the above-described composition, it is preferable that an image is plotted by moving the above-described printing medium by rotations of an opposed drum disposed at a position opposed to the above-described printing head via the above-described printing medium when plotting images on the above-described printing medium.

In the above-described composition, it is preferable that the above-described recording head is composed of a single-channel head or a multi-channel head, and images are plotted by moving the head in the axial direction of the opposed drum.

In the above-described composition, it is preferable that, when plotting images on the above-described printing medium, the above-described printing medium is placed between at least a pair of capstan rollers and is caused to run, thereby carrying out plotting.

In the above-described composition, it is preferable that the above-described recording head is composed of a single channel head or a multi-channel head, and the above-described recording head is caused to move in a direction orthogonal to the running direction of the above-described printing medium, thereby carrying out plotting.

In addition, in the above-described composition, it is preferable that the above-described recording head is composed of a full-line head having roughly the same length as the width of the above-described printing medium.

Also, In the above-described composition, it is preferable that the above-described ink jet image plotting unit has ink feeding unit for feeding ink, which feeds the above-described oil-based ink to the above-described recording head.

Further, in the above-described composition, it is preferable that the apparatus has ink collecting unit for collecting ink, which collects the above-described oil-based ink from the above-described recording head, wherein ink is circulated.

Still further, in the above-described composition, it is preferable that the above-described ink jet image plotting unit has agitating unit for agitating the above-described oil-based ink in an ink tank that stores the above-described oil-based ink.

And, in the above-described composition, it is preferable that the above-described ink jet image plotting unit has ink temperature controlling unit for controlling ink temperature, which controls the temperature of the above-described oil-based ink in the ink tank that stores the above-described oil-based ink.

Also, in the above-described composition, it is preferable that the above-described ink jet image plotting unit has ink concentration controlling unit for controlling ink concentration, which controls concentration of the above-described oil-based ink.

In addition, the above-described in-press image plotting and offset printing apparatus is featured in that the above-described image forming unit is provided with a fixation unit of the above-described ink.

Also, the above-described in-press image plotting and offset printing apparatus may be featured in that, when plotting images on the above-described plate material, the above-described image forming unit carries out main scanning by rotations of the plate cylinder to which the above-described plate material is attached Further, the above-described in-press image plotting and offset printing apparatus may be featured in that the above-described recording head is composed of a single-channel head or a multi-channel head, and when plotting images onto the above-described plate material, the corresponding recording head carries out subscanning when moving in the axial direction of the above-described plate cylinder.

In addition, the above-described in-press image plotting and offset printing apparatus may be featured in that the above-described recording head is composed of a full-line head having roughly the same length as the width of the plate cylinder.

Also, the above-described in-press image plotting and offset printing apparatus may be featured in that the above-described image plotting unit is provided with ink feeding unit that feeds ink to the above-described recording head.

Also, the above-described in-press image plotting and offset printing apparatus may be featured in that the same is provided with ink collecting unit from the above-described recording head, wherein ink circulation is enabled by the above-described ink feeding unit and ink collecting unit.

Also, the above-described in-press image plotting and offset printing apparatus may be featured in that an ink tank for storing the above-described oil-based ink is internally provided with ink agitating unit.

Also, the above-described in-press image plotting and offset printing apparatus may be featured in that the ink tank for storing the above-described oil-based ink is internally provided with ink temperature controlling unit for controlling ink temperature.

Also, the above-described in-press image plotting and offset printing apparatus may be featured in that the same is provided with ink concentration controlling unit for controlling concentration of the above-described ink.

Also, the above-described in-press image plotting and offset printing apparatus may be featured in that the same is provided with recording head contacting and releasing unit by which, when the above-described ink jet image plotting unit plots images onto the above-described plate cylinder, the above-described recording head is approached to the above-described plate cylinder, and, at other times than plotting images on the corresponding plate material, the corresponding recording head is released from the corresponding plate cylinder.

Also, the above-described in-press image plotting and offset printing apparatus may be featured in that the above-described image forming unit is provided with recording head cleaning unit that carries out cleaning of the above-described recording head at least after making a plate.

Also, the above-described in-press image plotting and offset printing apparatus may be featured in that the above-described offset printing unit is provided with paper dust removing unit that is able to remove paper dust occurring when performing offset printing.

DETAILED DESCRIPTION OF THE PREFERRED EMBODIMENTS

Hereinafter, a detailed description is given of the embodiments of the invention. The invention is featured in removing dust and foreign matter adhered to the above-described printing medium in an ink jet method in which oil-based ink is discharged, with electrostatic fields, onto a printing medium that is fed to a printing press.

An ink jet method pertaining to the invention is described in PCT WO93/11866 Patent Specification, wherein ink having high resistance, in which at least colored droplets are dispersed in an insulative solvent, is used in the ink jet method, and an intensive electric field is operated onto the ink at a discharge position, whereby the aggregate of the corresponding coloring droplets is formed at the discharge position, and further the corresponding aggregate is discharged from the discharge position by electrostatic unit. Thus, the coloring droplets are discharged as a highly condensed aggregate, and ink drops include only slight solvents. Therefore, a fine image of high concentration, which is free from any blur, can be formed on printing paper or a printing plastic film, which is used as a recording medium.

Also, in the present ink jet method, the size of the discharged ink drops is determined by the size of the tip end portion of a discharge electrode and electric field forming conditions. Accordingly, if a small discharge electrode and adequate electric field forming conditions are used, small ink drops can be obtained without decreasing the diameter of the discharge nozzle and the slit width thereof.

Therefore, minute images can be controlled without any problem of clogging of ink in the head. The present invention provides an ink jet printing method that enables printing of fine images of high quality.

Construction examples of a printing press that is used to embody the ink jet printing method according to the invention are shown below. However, the invention is not limited to the following construction examples.

FIG. 1 through FIG. 6 are views showing general construction examples of a printing press, according to the invention, for carrying out plotting by moving a printing medium by rotations of an opposed drum.

Figure 1:
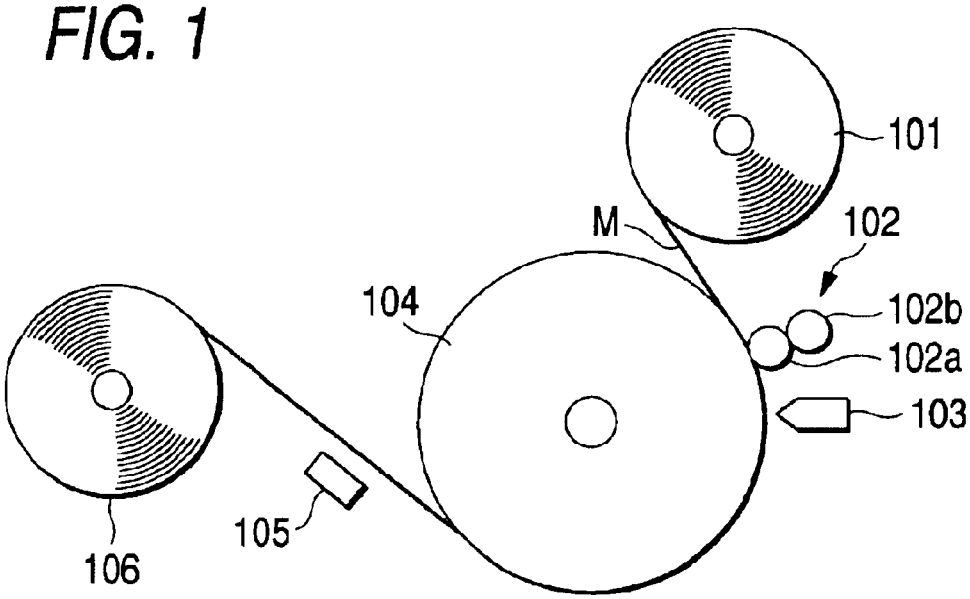
FIG. 1 is an exemplary view showing a general construction of a web type apparatus that is able to carry out single-side mono-color printing, which is one of the examples of an ink jet printing press according to the invention.
Figure 2:
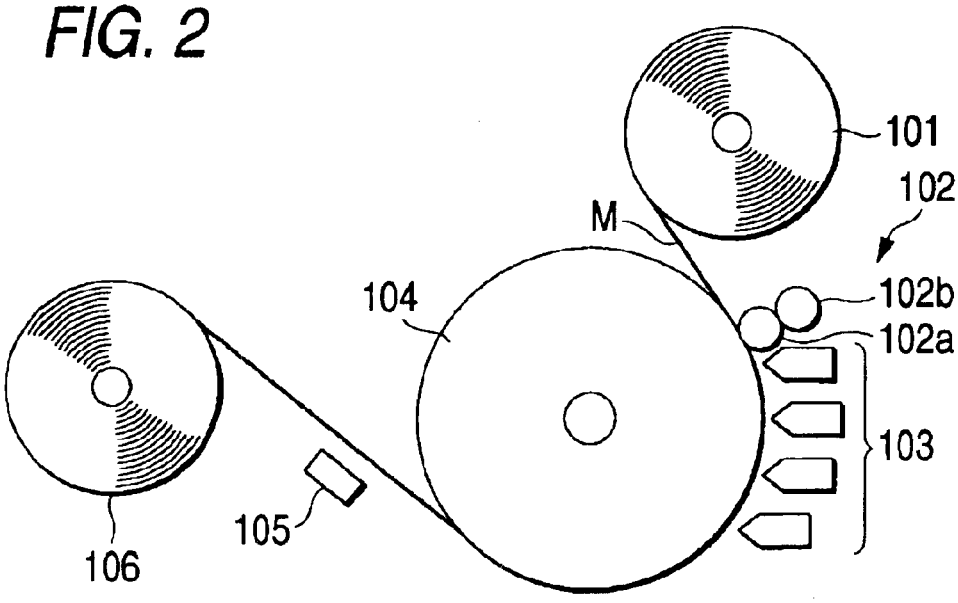
FIG. 2 is an exemplary view showing a general construction of a web type apparatus that is able to carry out single-side four-color printing, which is another example of an ink jet printing press according to the invention.
Figure 3:
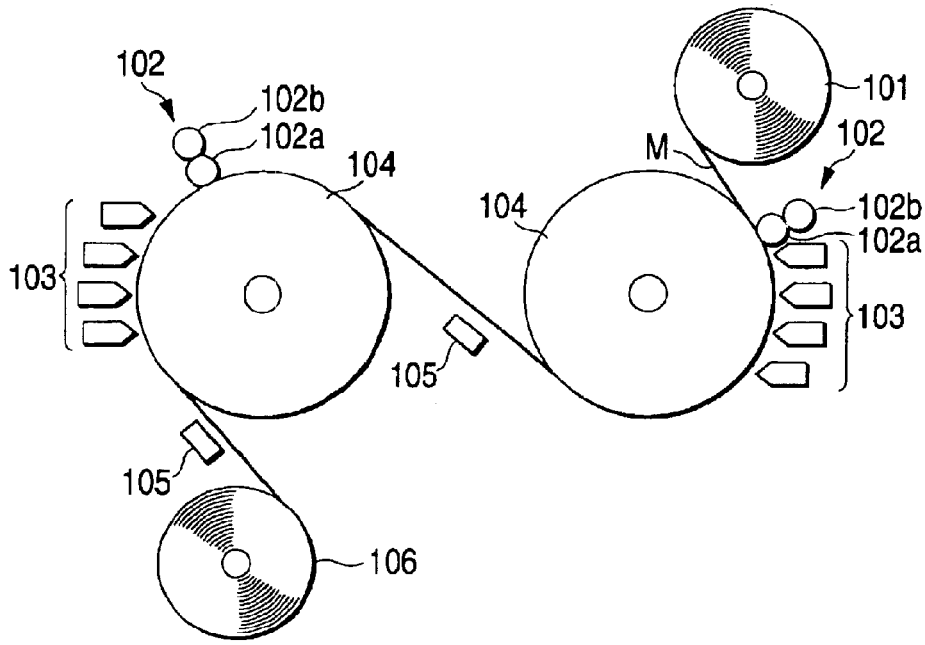
FIG. 3 is an exemplary view showing a general construction of a web type apparatus that is able to carry out double-side four-color printing, which is still another example of an ink jet printing press according to the invention.
Figure 4:
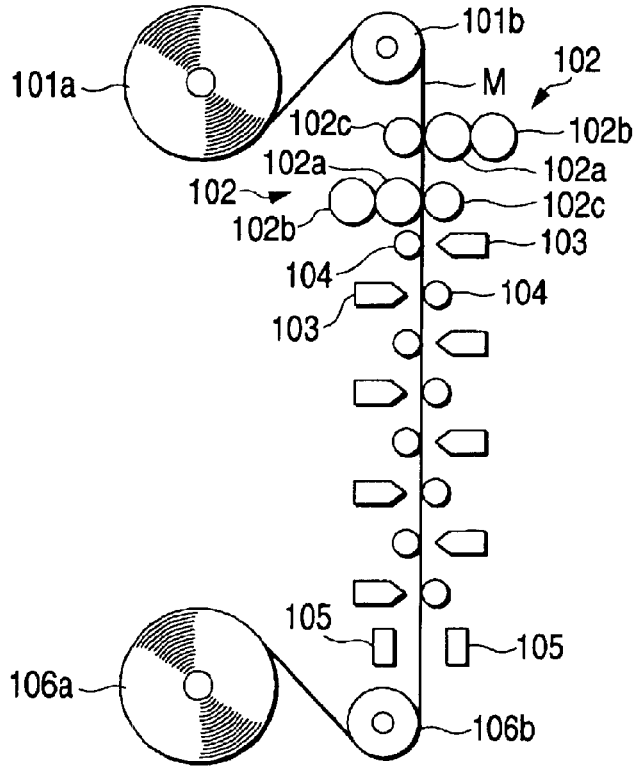
FIG. 4 is an exemplary view showing a general construction of a web type apparatus that is able to carry out double-side four-color printing, which is still another example of an ink jet printing press according to the invention.

FIG. 1 through FIG. 4 are views showing general construction examples of a web-type printing press in which a roll-shaped printing medium is applied between the opposed rum and a printing medium feeding roll and a printing medium winding roll or a guide roll. FIG. 1 shows a web type apparatus intended for use as single-side and mono-color printing, FIG. 2 shows a web-type apparatus intended for use as single-side and four-color printing, and FIG. 3 and FIG. 4 show general construction examples of a double-side and four-color printing press.

Figure 5:
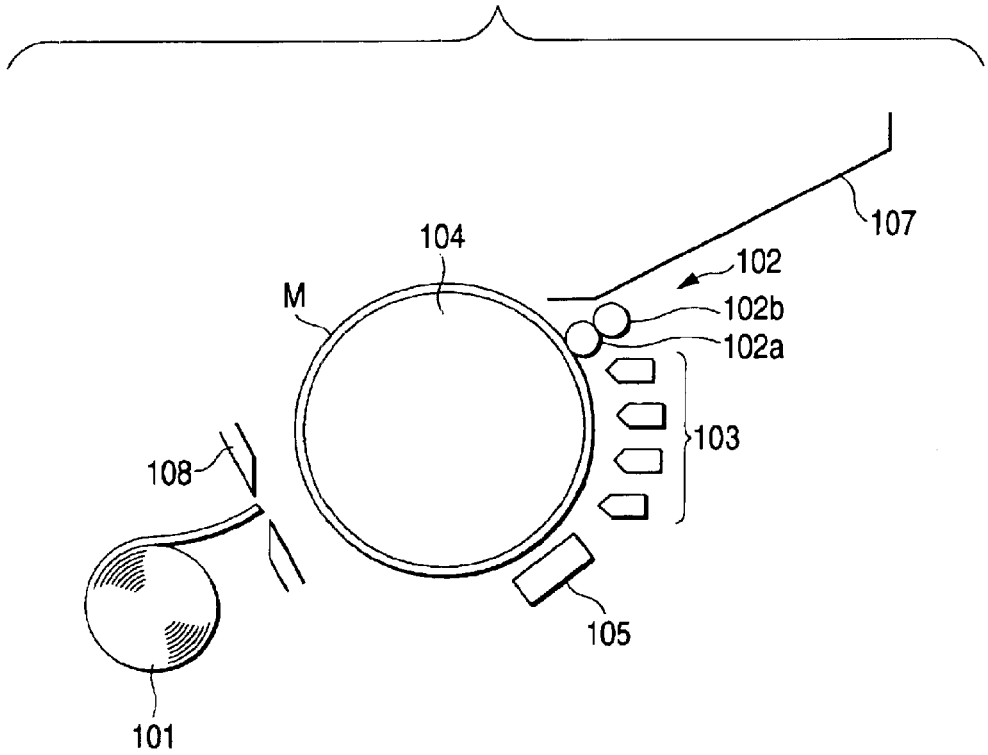
FIG. 5 is an exemplary view showing a general construction of a single-side four-color printing press that is able to carry out printing by cutting a roll-shaped printing medium and winding the same on the opposed drum, which is still another example of an ink jet printing press according to the invention.
Figure 6:
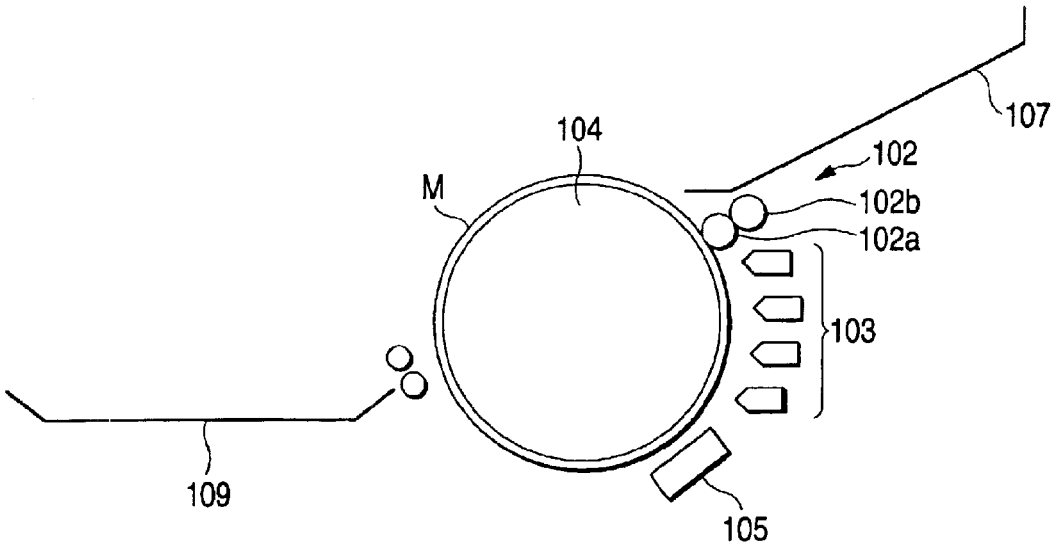
FIG. 6 is an exemplary view showing a general construction of a printing press using a sheet-shaped printing medium, which is still another example of an ink jet printing press according to the invention.

Also, FIG. 5 is a view showing a general construction example of a single-side and four-color printing press in which a roll-shaped printing medium is cut off and is wound on the opposed drum for printing, and FIG. 6 is a view showing a general construction example of a printing press in which a sheet-shaped recording medium is employed.

Figure 7:
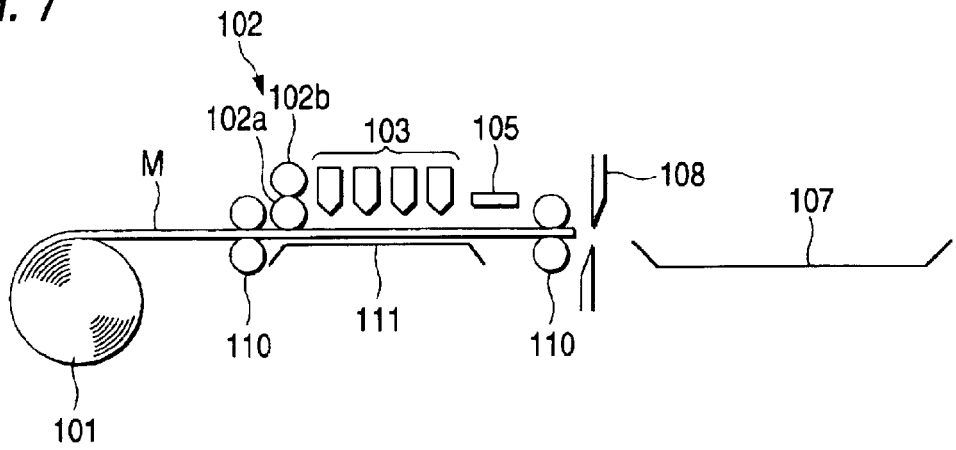
FIG. 7 is an exemplary view showing a general construction of a printing press that is able to carry out plotting images by causing a roll-shaped printing medium to be placed and transferred by capstan rollers, which is still another example of an ink jet printing press according to the invention.
Figure 8:
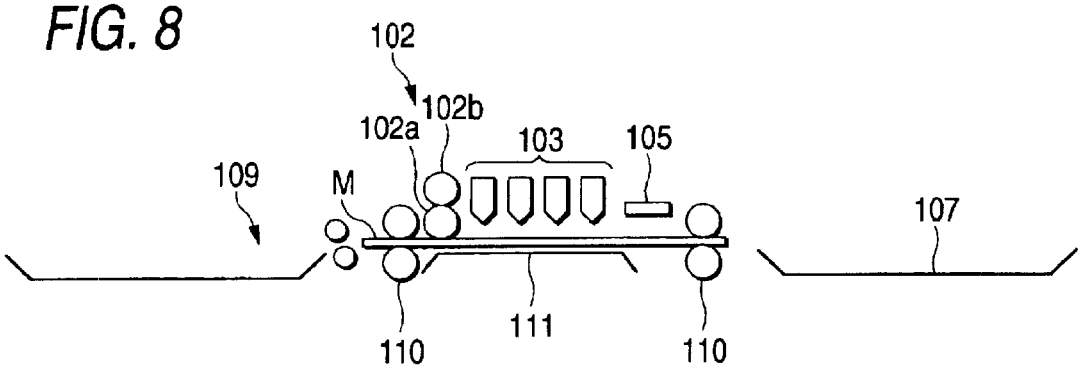
FIG. 8 is an exemplary view showing a general construction of a printing press that is able to carry out plotting images by causing a sheet-shaped printing medium to be placed and transferred by capstan rollers, which is still another example of an ink jet printing press according to the invention.

On the other hand, FIG. 7 and FIG. 8 are views showing a general construction example of a printing press that carries out plotting by causing a printing medium to be placed and to run between capstan rollers according to the invention. Of these, FIG. 7 is a view showing a general construction example of a printing press in which a roll-shaped printing medium is used, and FIG. 8 is a view showing a general construction example of a printing press in which a sheet-shaped printing medium is used.

In the respective printing presses shown in FIG. 1 through FIG. 8, an adhesive roller 102 is commonly installed on the basis of the invention. The adhesive roller 102 is described in detail later. However, the adhesive roller is rolled on a printing medium before and/or during forming images on the printing medium, and removes dust and foreign matter existing on the printing medium.

Figure 9:
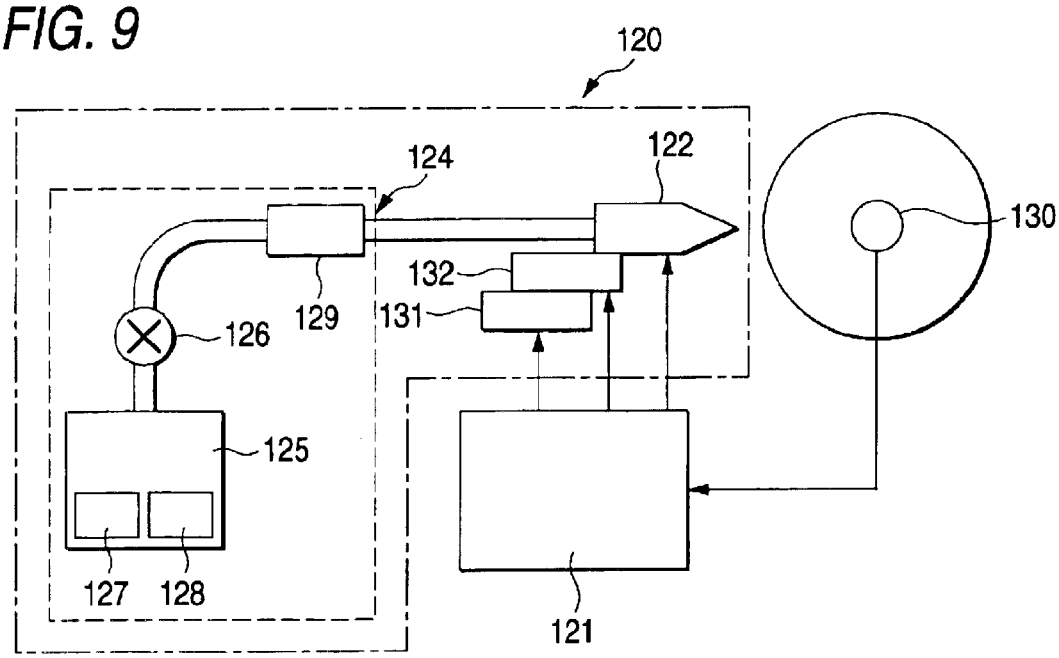
FIG. 9 is a view showing a general construction example of an image plotting unit, including a controlling portion, an ink feeding portion, and a head contacting and releasing mechanism, of an ink jet printing press according to the invention.

FIG. 9 shows a general construction example of an image plotting unit (an image forming unit) including a controlling portion of the image plotting unit, an ink feeding portion and a head contacting and releasing mechanism. In addition, FIG. 10 through FIG. 16 are provided to describe an ink jet recording unit with which the image plotting unit shown in FIG. 9 is provided.

First, a description is given of a printing process according to the invention, using a general construction view of FIG. 1, which shows an apparatus for executing single-side mono-color printing on a roll-shaped printing medium.

An ink jet printing press (hereinafter called a "printing press") shown in FIG. 1 is comprised of a roll-shaped printing medium feeding roll 101, an adhesive roller 102, an image plotting unit 103, an opposed drum (image plotting drum) 104 disposed opposite to the image plotting unit 103 via the printing medium, a fixation unit 105, and a printing medium winding roll 106.

After dust and foreign matter existing on a printing medium delivered by the feeding roll 101 are removed by the adhesive roller 102, ink is discharged, as per image, from an ink discharge portion (described later) of the image plotting unit 103 onto the corresponding printing medium on the image plotting drum 104, and a printing image is recorded. After the image is fixed on the printing medium by the fixation unit 105, a printing medium on which printing has been completed is wound onto the printing medium winding roll 106.

A metallic roll or a roll having a conductive rubber layer on the surface thereof, or that having a metallic layer formed on the surface of an insulative drum such as plastic, glass, ceramic, etc., by deposition or plating is used as the opposed (image plotting) drum 104 in order to make it into an opposed electrode with respect to the discharge electrode of the ink discharge portion, whereby an effective electric field can be formed between the opposed (image plotting) drum 104 and the discharge portion of the image plotting unit 103. Also, where heating unit is provided at the image plotting drum 104 in order to increase the drum temperature, it is effective to improve the image plotting quality. Quick fixation of discharged ink liquid drops on the printing medium can be accelerated, wherein blur can be further suppressed.

In addition, physical property values of the ink liquid drops discharged on the printing medium are controlled by making the drum temperature constant, wherein stabilized and uniform dots can be formed. It is further preferable that cooling unit is added in order to make the drum temperature constant.

The ink jet printing press has an adhesive roller 102 disposed at the upstream side of the printing medium in its moving direction in the image plotting unit 103, which adsorbs and removes dust and foreign matter existing on the printing medium, so that the adhesive roller 102 can roll on the printing medium. Also, "roll" herein unit that the adhesive roller 102 is brought into contact with the printing medium and is caused to move relative to the printing medium while rotating (including driven rotations or self revolutions). In the construction of the present embodiment, since the adhesive roll 2 rotates at a fixed position with respect to a moving printing medium, the adhesive roller 102 and the printing medium move relative to each other.

The adhesive roller 102 can be brought into contact with and released from the surface of a printing medium by a contacting and releasing mechanism (not illustrated) The adhesive roller 102 removes dust and foreign matter existing on the surface of a printing medium before and/or during plotting images on the printing medium. That is, removal of dust and foreign matter on the printing medium may be carried out only before plotting images, only during plotting the image or before and during plotting the same. The adhesive roller 102 may be formed by coating the outer circumference of a cylindrical core material composed of, for example, metal, with an adhesive layer. For example, a rubber-based adhesive agent or acrylate-based adhesive agent may be listed as the adhesive layer. It is preferable that the adhesive force of the adhesive roller 102 is 4 hPa or more but 250 hPa or less, which is defined by the method according to "Test for rubber adhered between two parallel metallic plates" in the article of "Adhering test with respect to metal and vulcanized rubber" as regulated by JIS-K6301 "Method for physical test of vulcanized rubber". However, it is further preferable that the adhesive force is 7 hPa or more but 180 hPa or less. As the results of evaluation of adhesive forces and performance of the adhesive roller 102 are shown in Table 1, if the adhesive force is 4 hPa or less, it is almost impossible to remove dust and foreign matter, wherein the roller cannot be used as the adhesive roller 102. Although an effect of removing dust and foreign matter can be observed in a case where the adhesive force is 4 hPa or more, the effect can be further improved if the adhesive force is 7 hPa or more. Also, where an adhesive roller 102 whose adhesive force is 250 hPa or more is used, a printing medium may be broken, or a printing medium may be wrinkled, wherein inconvenience arises in transfer thereof. The adhesive roller can be used if the adhesive force is 250 hPa or less. However, it is further preferable that the adhesive force is 180 hPa or less, wherein none of the above-described problems occur, and the quality level can be further improved when executing printing.

TABLE 1

| Adhesive force [hPa] | Performance of removing dust and foreign matter | Results of evaluation of printed matter |
|---|---|---|
| 3 | X | ○ |
| 4 | Δ | ○ |
| 7 | ○ | ○ |
| 180 | ○ | ○ |
| 250 | ○ | Δ |
| 300 | ○ | X |

The adhesive roller 102 may be composed of a single adhesive roller or may be composed of two or more adhesive rollers whose adhesive forces may differ from each other. In the present embodiment, the adhesive roller 102 may be composed of two adhesive rollers 102*a* and 102*b*. In such a construction, one adhesive roller 102*a* is caused to roll on a printing medium, and the other adhesive roller 102*b* is directly or indirectly brought into contact with the former adhesive roller 102*a*, wherein dust and foreign matter adhered to the adhesive roller 102*a* are adsorbed and removed by the latter adhesive roller 102*b*.

Herein, "directly" unit a construction (the present embodiment) in which the other adhesive roller 102*b* is brought into contact with the adhesive roller 102*a* and rolls altogether. Therefore, where two or more adhesive rollers 102*b* are provided, a plurality of adhesive rollers 102*b* are brought into contact with the adhesive roller 102*a* at the same time. Also, "indirectly" unit a construction in which, where the adhesive rollers 102*b* are provided in a plurality, the adhesive rollers 102*b* are brought into contact with each other in series. Therefore, in this mechanism, one adhesive roller 102*b* is brought into contact with the adhesive roller 102 at all times. And, the adhesive force of the adhesive roller 102*b* is set to be greater than that of the adhesive roller 102*a*. That is, the adhesive roller 102*b* functions as a cleaning roller of the adhesive roller 102*a*. Further, in the case of a construction in which adhesive rollers 102*b* are provided in a plurality, and the adhesive rollers 102*b* (adhesive roller 102*b*1, 102*b*2, 102*b*3, . . . ) are brought into contact with each other in series, the adhesive forces thereof are set to be 102*b*1<102*b*2<102*b*3< . . . .

According to the former direct contacting, dust and foreign matter of the adhesive roller 102*a* can be adsorbed and removed by a plurality of adhesive rollers 102*b* at the same time. Also, according to the latter indirect contacting, dust and foreign matter adhered to the adhesive roller 102*a* are adsorbed and removed by the other adhesive rollers 102*b* one after another. Dust and foreign matter adhered to the adhesive roller 102*a* can be adsorbed and removed by clean adhesive rollers 102*b* where no dust and foreign matter are adhered, wherein the adsorption and removal performance of dust and foreign matter can be maintained for a long period of time, and it is possible to prevent dust and foreign matter from inversely adhering from the adhesive roller 102*a* to a printing medium.

Further, the image plotting unit 103 includes an ink jet recording unit 120 as shown in FIG. 9. In the ink jet recording unit 120, oil-based ink is discharged onto a printing medium by an electrostatic field, which is formed between the recording head 122 and the opposed drum 104, corresponding to image data that are sent from an image data calculation controlling portion 121, and an image plotting image is formed.

The image data calculation controlling portion 121 receives image data from an image scanner, a magnetic disk unit, an image data transmission unit, etc., and carries out color decomposition. Further, the controlling portion 121 calculates the decomposed color data for dividing the same into adequate pixels and graduation scales and distributes these data to respective heads.

In addition, since oil-based ink images are made into dots by using an ink jet recording head 122 (described later, see FIG. 10) that the ink jet recording unit 120 has, the controlling portion 121 calculates dot area ratios.

As described later, the image data calculation controlling portion 121 controls movement of the ink jet heads 122 and the discharge timing of oil-based ink, and at the same time, controls the timing of a printing medium movement.

With reference to FIG. 1 and FIG. 9, a detailed description is given of a printing process that is carried out by a printing press.

A printing medium that is sent out from a printing medium feeding roll is given tension by the drive of a printing medium winding roll, and is brought into contact with the image plotting (opposed) drum, whereby a printing medium web vibrates and is brought into contact with the ink jet recording unit when plotting images in order to prevent the web from being damaged.

Also, unit for closely adhering a printing medium to the image plotting (opposed) drum in only the vicinity of the image plotting position of the ink jet recording unit is provided. And by actuating the unit at least when plotting images, it is possible to prevent the printing medium from being brought into contact with the ink jet recording unit. In detail, it is effective to use a guide having a press roller at the upstream side and the downstream side of the image plotting position of the image plotting drum, or to use unit for electrostatic adsorption.

Image data that are sent from the magnetic disk unit, etc., are provided to the image data calculation controlling portion 121, and the image data calculation controlling portion 121 calculates discharge positions of oil-based ink and dot area ratios at a position on the basis of the input image data. These calculation data are once stored in a buffer. The image data calculation controlling portion 121 approaches the recording head 122 to a position, which is close to a printing medium brought into contact with the image plotting drum, by a head contacting and releasing unit 131. The distance between the recording head 122 and the surface of the image plotting drum is maintained at a fixed distance during plotting images, by mechanical distance control such as a butting roller, or control of a head contacting and releasing unit using signals from an optical distance detector. A single channel head, a multi-channel head, or a full-line head may be used as the recording head 122.

Where the single channel head or multi-channel head is used as the recording head 122, the array direction of the discharge portion is established roughly parallel to the travelling direction of a printing medium, and printing is executed by carrying out main scanning by movement of the recording head in the axial direction of the above-described opposed drum and subscanning by rotations of the above-described opposed drum. Movement control of the above-described opposed drum and recording head is carried out by the image data calculation controlling portion 121, and the recording head discharges oil-based ink on the basis of the discharge position and dot area ratios, which are obtained by the above-described calculation, whereby a dot image responsive to shading of a printing document is plotted by oil-based ink. The operation is continued until an appointed ink image is formed on a printing medium.

On the other hand, where the recording head 122 is a full line head having roughly the same length as the width of the drum, the array direction of the discharge portion is established roughly orthogonal to the travelling direction of a printing medium, and the printing medium is caused to pass through the image plotting portion by rotations of the opposed drum, wherein an oil-based ink image is formed to complete a printed matter.

After the printing is completed, in order to protect the recording head 122, the recording head 122 is retreated so that it is released from a position close to the image plotting drum. At this time, although only the recording head 122 may be contacted and released, the recording head 122 and ink feeding portion 124 may be contacted and released altogether.

The contacting and releasing unit operates the recording head so that the head is released so as to be apart by at least 50 $\mu$m or more from the image plotting drum except when plotting images. The contacting and releasing action may be brought about by a sliding movement, or the head is fixed by an arm fixed at a certain axis, and the arm may be moved around the axis just like a pendulum. Thus, by causing the head to retreat when not plotting images, the head can be protected from physical damage or being stained, wherein a longer life of the head can be brought about.

Also, a formed oil-based ink image is intensified by the fixation unit 105. Fixation unit that are publicly known, such as heating fixation, solvent fixation, etc., may be used as the fixation unit 105. With respect to the heating fixation, irradiation of an infrared ray lamp, halogen lamp, xenon flash lamp, etc., or hot air fixation using a heater, or heat roll fixation is common.

In this case, in order to increase a fixation property, various unit such as heating of the plate cylinder, preheating of the plate material, plotting of images while applying hot air thereto, coating of the plate cylinder with a heat insulating material, heating of only the plate material with the plate material released from the plate cylinder when fixing, etc., may be effectively employed individually or in combination thereof.

Flash fixation using a xenon lamp, etc., is publicly known as a fixation method of an electro-photography toner. It is advantageous in that fixation can be carried out in a short time. Also, where laminated paper is used, moisture contained in paper is evaporated by a radical temperature rise, whereby a blister is produced, by which projections and recesses are generated on the surface of paper. Therefore, a plurality of fixation units are disposed, and a power supply level and/or distance from the fixation unit to a recording medium are varied so that the paper temperature gradually rises. This is favorable in view of preventing the blister.

Also, where a plurality of fixation units are disposed in the rotating direction of the drum, and the distance to the plate material and/or feeding power are varied, it may be constructed so that the temperature of the paper plate material may gradually rise.

In the case of solvent fixation, a solvent such as methanol, ethyl acetate, etc., which can dissolve resin constituents in ink, is sprayed or vapor thereof is provided to a printing medium, and surplus solvent vapor is collected.

Also, at least in a process from formation of oil-based ink images by the recording head 122 to fixation made by the fixation unit 105, it is preferable that images on the printing medium are maintained with nothing brought into contact therewith.

FIG. 2 through FIG. 4 show construction examples of a single-side four-color printing press and a double-side four color printing press. Also, in FIG. 4, reference numeral 2*c* denotes a press roller. The press roller 102*c* may be such that it is freely brought into contact with or released from the adhesive roller 102 by a contacting and releasing mechanism (not illustrated), and is fixed at an appointed position. Also, the press roller 102*c* may be driven and rotated by the adhesive roller 102, or may self-revolve in synchronization with the adhesive roller 102. In the adhesive roller 102 provided with the press roller 102*c*, it is possible to securely remove dust and foreign matter existing on a printing medium while printing the adhesive roller 102 onto the printing medium even in the case of a printing press not having any image plotting unit 104. Since operational principles in the other construction examples can be easily inferred from the description of the above-described single-face monochrome printing press, description thereof is omitted.

Further, although the construction example of a four-color printing press is shown herein, the invention may not be limited to this example, wherein the number of colors may be optionally established as necessary.

FIG. 5 and FIG. 6 show another construction example according to the invention. These drawings are views explaining a printing press, which has an automatic delivery unit 107 and a printing medium is wound on the opposed drum for use. FIG. 6 shows a construction example of a printing press, having an automatic feeding unit 109, in which a sheet-shaped printing medium is used. Herein, a description is given, using a construction example of the apparatus employing a roll-shaped printing medium, which is shown in FIG. 5.

First, a printing medium taken out from the printing medium feeding roll 101 and cut to an optional size by a cutter 108 is mounted on the opposed drum. At this time, the printing medium is adhered to and fixed on the drum by a mechanical method such as a publicly known sheet top and/or tail gripper unit, air suction unit, or also a publicly known electrostatic method, etc., whereby it is possible to prevent the printing medium from being brought into contact with the ink discharge image plotting unit 103 when plotting images and being damaged or broken due to flapping of the medium tail.

In addition, the ink discharge image plotting unit 103 has a unit adhering and fixing the printing medium on the drum only around a plotting position thereof. At least when the ink discharge image plotting unit plots, it can be prevented that the printing medium contacts to the ink jet recording apparatus. In the specification, for example, it is preferable a method that a pressing roller is disposed on a upstream and/or a downstream of the plotting position of the opposite drum.

Further, in the case of the plotting is not carried out, it is preferable that the head is disposed to be separated from the printing medium. Therefore, it is well prevented a damage of the ink discharge image plotting unit caused by contact of the head.

A single channel head, a multi-channel head or a full-line head may be used as the recording head 122, wherein main scanning is carried out by rotations of the opposed drum 104. In the case of the multi-channel head or full-line head having a plurality of discharge portions, the arraying direction of the discharge portions is disposed in the axial direction of the opposed drum 104.

Further, in the case of the single channel head or multi-channel head, the head 122 is moved in the axial direction of the opposed drum by the image data calculation controlling portion 121 consecutively or successively, and oil-based ink is discharged onto a printing medium attached to the drum 104 at a discharge position and a mesh-dot area ratio, which are obtained by calculations of the image data calculation controlling portion 121, wherein dotted images in response to shading of a printing document are plotted on a printing medium with oil-based ink. The operation is continued until the appointed oil-based ink images are formed on the printing medium.

On the other hand, where the head 122 is a full-line head having roughly the same length as the width of the drum, an oil-based ink image is formed on the printing medium by a single turn of the drum, and printed matter is brought about. Since the main scanning is thus carried out by rotations of the drum, the positioning accuracy in the main scanning direction can be increased, and the image plotting can be carried out at a high speed. A printed medium is fixed by the fixation unit 105, and is delivered by the automatic delivery unit 107.

Herein, a single-side four-color printing press is shown. However, the present invention is not limited to this. It may be possible to optionally determine the configuration including the number of colors, single-side or double-side printing, etc., as necessary.

On the other hand, FIG. 7 and FIG. 8 show a general construction example of a printing press for plotting images by causing a printing medium to be held by capstan rollers according to the invention and causing the same to travel. FIG. 7 shows a printing press in which a roll-shaped printing medium is used, and FIG. 8 shows a general construction example of a printing press in which a sheet-shaped printing medium is used.

Herein, a description is given, using an entire construction view of an apparatus that carries out single-side four-color printing on a roll-shaped printing medium. A printing medium M is held and transferred by two pairs of capstan rollers 110, and images are plotted by the ink discharge image plotting unit 103, using data calculated and divided into an adequate number of pixels and number of graduation scales by the image data calculation controlling portion (Reference numeral 121 in FIG. 9). It is preferable that earthing unit 111 that becomes an opposed electrode of the recording head electrode in electrostatic field discharge is provided at a position where plotting is carried out by the ink discharge image plotting unit 103, wherein the image plotting can be facilitated.

Also, in FIG. 7, the construction includes a sheet cutter 108 at the upstream side of the automatic delivery unit 107 in order to cut a roll-shaped printing medium. However, the sheet cutter may be disposed at any optional place.

Next, a detailed description is given below of a process for producing printed matter by a printing press according to the invention with reference to FIG. 7.

First, a printing medium is transferred by capstan rollers 110. At this time, by providing printing medium guiding unit (not illustrated) as necessary, it is possible to prevent the printing medium from being brought into contact with the ink discharge image plotting unit 103 and being damaged or broken due to flapping of the top and/or tail of the printing medium. Unit for preventing a printing medium from slackening only around the image plotting position of the ink discharge image plotting unit is disposed, and the unit is actuated at least when plotting images, whereby the printing medium can be prevented from being brought into contact with the ink discharge image plotting unit. In detail, for example, such a method of disposing a press roller at the upstream side and downstream side of the image plotting position may be available, In addition, when not plotting images, it is preferable that the head is released from the printing medium, whereby it is possible to prevent any inconvenience from occurring, by which a printing medium is brought into contact with the ink discharge image plotting unit and is damaged or broken.

Image data from a magnetic disk unit, etc., are provided to the image data calculation controlling portion 121 in FIG. 9, and the image data calculation controlling portion 121 calculates a discharge position of oil-based ink in response to the input image data and dot area ratios at the position. These calculation data are once stored in a buffer.

The image data calculation controlling portion 121 controls movement of the ink jet head 122, discharge timing of oil-based ink, and operation timing of the capstan rollers, and at the same time, as necessary, approaches the recording head 122 at a position in the vicinity of the printing medium by a head contacting and releasing unit 131. The distance between the recording head 122 and the surface of a printing medium is maintained at an appointed distance by a mechanical distance control such as butting rollers or control of the head contacting and releasing unit based on signals from an optical distance detector during plotting images. With such distance control, dot diameters are prevented from becoming uneven due to floating of the printing medium, and are not changed even if vibrations are applied to the printing press, wherein satisfactory printing can be carried out.

A single-channel head, a multi-channel head or a full-line head may be used as the recording head 122. Subscanning is carried out by transfer of a printing medium. Where the multi-channel head having a plurality of discharge portions is employed, the array direction of the discharge portion is determined roughly parallel to the travelling direction of a printing medium. Further, where the single-channel head or multi-channel head is employed, the head 122 is moved in a direction orthogonal to the travelling direction of the printing medium by the image data calculation controlling portion 121, and oil-based ink is discharged at the discharge portion and dot area ratios, which are obtained by the above-described calculation. Therefore, dotted images responsive to shading of a printing document are plotted with oil-based ink on the printing medium. The operation is continued until appointed oil-based ink images are formed on the printing medium on the other hand, where the recording head 122 is a full-line head having roughly the same length as the width of the drum, the array direction of the discharge portion is determined roughly orthogonal to the travelling direction of a printing medium, wherein since the printing medium is caused to pass through the image plotting portion, oil-based ink images are formed on the printing medium. The printed medium is fixed by the fixation unit 105, and is automatically delivered by an automatic delivery unit.

Herein, although a single-face four-color printing press is illustrated, the invention is not limited to this type, wherein it is possible to freely determine the number of colors, single-side or double-side printing.

Also, a detailed description is given of the ink discharge image plotting unit 103, using FIG. 9.

As shown in FIG. 9, an image plotting unit used for the present ink jet printing method is comprised of a recording head 122 and an ink feeding portion 124.

The ink feeding portion 124 further includes an ink tank 125, an ink feeding unit 126, and ink concentration controlling unit 129. Agitating unit 127 and ink temperature controlling unit 128 are included in the ink tank. Ink may be circulated in the head. In this case, the ink feeding portion has an ink collection and circulation feature. The agitating unit 127 suppresses solid constituents of ink from being deposited or aggregated. A rotary impeller, an ultrasonic vibrator, and a circulation pump may be used as the agitating unit. One of these or a combination thereof may be employed. The ink temperature controlling unit 128 are disposed so that high quality images can be continuously formed without any change in the physical properties of ink or any change in the dot diameters due to a change in the surrounding temperature. A heater, heat generating elements such as Peltier elements or cooling elements are disposed along with the agitating unit in the ink tank as the ink temperature controlling unit, so that the temperature distribution in the corresponding tank can be made constant, and already known methods may be adopted, for example, temperature is controlled by a temperature sensor, for example, a thermostat. In addition, it is preferable that the ink temperature in the ink tank is 15° C. or more but 60° C. or less, and it is further preferable that the ink temperature is 20° C. or more but 50° C. or less. Also, the agitating unit for uniformly keeping the temperature distribution in the tank may be conjugated by agitating unit for the sake of suppressing deposition and aggregation of solid constituents of the above-described ink. In addition, the present image plotting printing unit is provided with unit 129 for controlling the ink concentration to carry out high quality plotting images. The ink concentration is controlled by physical property measurement such as optical detection, conductivity measurement, viscosity measurement, etc., or by checking the number of images plotted. Where the ink concentration is controlled by measurement of physical properties thereof, an optical detector, a conductivity measurement instrument, a viscosity measurement instrument, etc., may be provided individually or in combinations thereof in the ink tank or in an ink flow channel, and output signals therefrom are used to control the ink concentration. In addition, where the ink concentration is controlled by the number of images plotted, ink liquid is supplied from a supplement concentrating ink tank or a diluting ink carrier tank, which are not illustrated, into the ink tank on the basis of the number of sheets printed, or frequency.

As described above, the image data calculation controlling portion 121 calculates input image data and picks up timing pulses from an encoder 130 which is installed at the head contacting and releasing unit 131, opposed drum or capstan rollers. And, the image data calculation controlling portion 121 drives the head on the basis of the timing pulses. Also, when plotting images by the ink jet recording unit, highly accurate driving unit are used to drive the image plotting drum. In detail, for example, such a method is available, in which an output from a highly accurate motor is reduced in terms of speed by highly accurate gears or a steel belt to drive the image plotting drum. By using such unit individually or in combinations, images can be further highly plotted.

Next, a description is given of the recording head with reference to FIG. 10 through FIG. 16. However, the present invention is not limited to the following examples.

Figure 10:
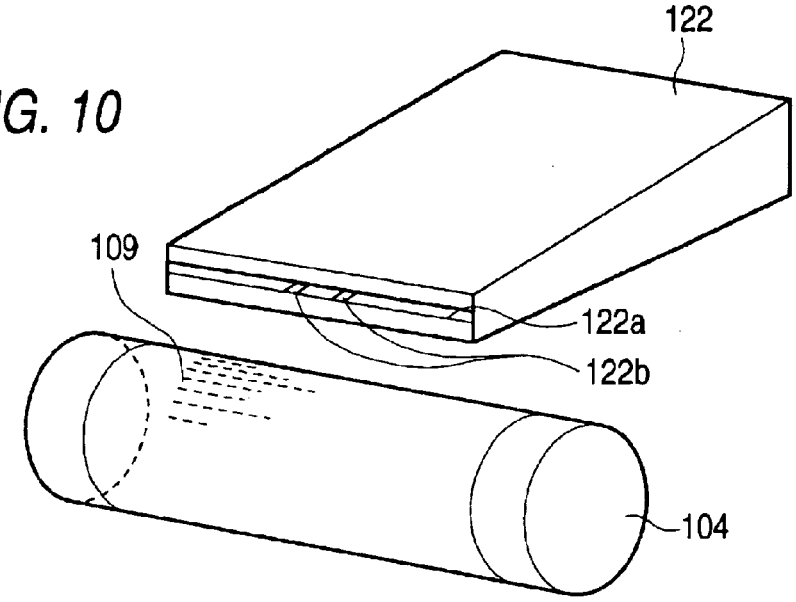
FIG. 10 is a view describing an ink jet recording unit with which the image plotting shown in FIG. 9 is provided.
Figure 11:
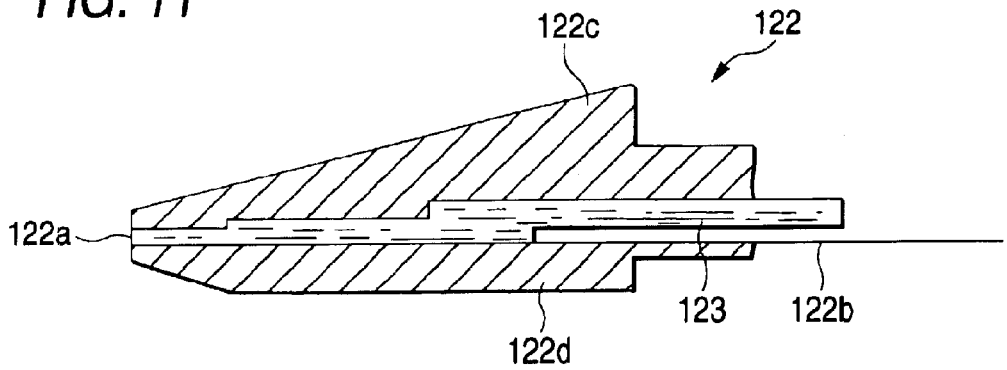
FIG. 11 is a view describing an enlarged section of an ink jet recording unit shown in FIG. 10.

FIG. 10 and FIG. 11 show one example of a head which is provided in the ink jet recording unit. The head 122 has a slit placed between the upper unit 122*c* and the lower unit 122*d*, which are composed of an insulative matrix. The tip end thereof is constructed to be a discharge slit 122*a*. A discharge electrode 122*b* is disposed in the slit 122*a*, and ink 123 fed from the ink feeding unit is filled in the slit. For example, plastic, glass, ceramic, etc., may be applied as the insulation matrix. Also, a discharge electrode 122*b* is formed by a publicly known method such as an etching method or a mechanically removing method or by a combination thereof after a conductive material such as aluminum, nickel, chrome, gold, platinum, etc., is vapor-deposited, spattered, or plated without any electric field on the lower unit 122*d* composed of an insulative matrix, a photo resist layer is coated thereon, and the photo resist layer is exposed to light via a mask having an appointed electrode pattern and developed to form a photo resist pattern of the discharge electrode 122*b*.

At the head 122, voltage is applied to the discharge electrode 122*b* in compliance with digital signals of pattern information of the data. As shown in FIG. 10, an image plotting drum that becomes an opposed electrode is installed in a fashion of opposing the discharge electrode 122*b*, and a printing medium is provided on the image plotting drum. By application of voltage, a circuit is formed between the discharge electrode 122*b* and the image plotting drum that becomes its opposed drum, and oil-based ink 123 is discharged from the discharge slit 122*a* of the head 122, wherein images are formed on the printing medium provided on the image plotting drum that becomes the opposed drum, It is preferable that the width of the discharge electrode 122*b* has as thin a tip end as possible in order to form high quality images. The detailed figures thereof may differ on the basis of conditions such as application voltage, physical properties of ink, etc., but the tip end width may normally be in a range from 5 through 100 $\mu$m.

Where it is assumed that a discharge electrode 122*b* whose tip end is, for example, 20 $\mu$m wide is used, an interval between the discharge electrode 122*b* and the image plotting drum 104 that becomes an opposed electrode is 1.0 mm, and voltage of 3 KV is applied between the electrodes for 0.1 milli-second, a dot of 40 $\mu$m is formed on the printing medium 9.

Figure 12:
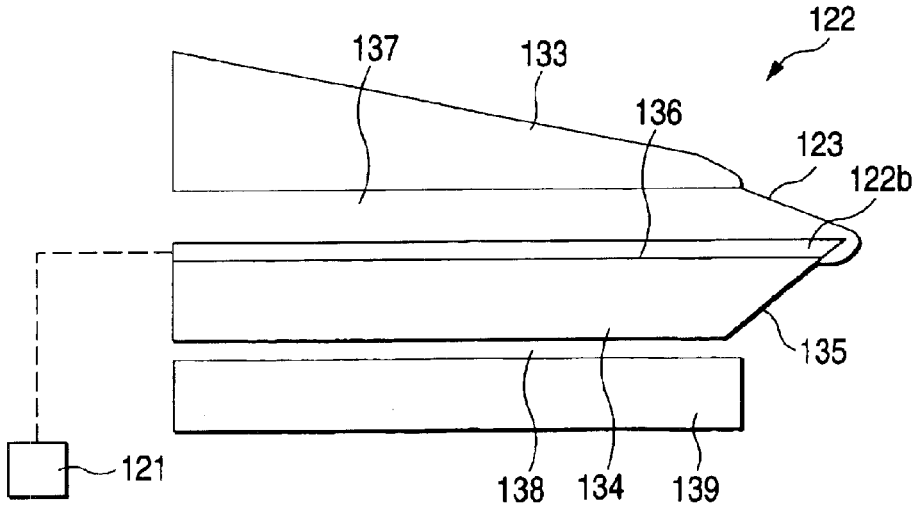
FIG. 12 is a view showing a rough section of the vicinity of the ink discharge portion in another example of the recording head.
Figure 13:
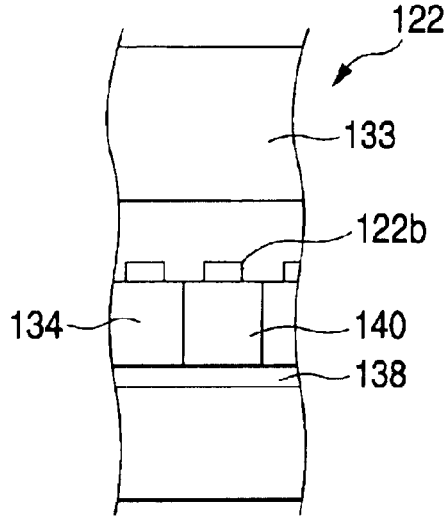
FIG. 13 is a view showing a general front side of the vicinity of the ink discharge portion of the example of the recording head.

Furthermore, FIG. 12 and FIG. 13 are, respectively, a rough sectional view of the vicinity of the ink discharge portion of another example of the recording head and a rough sketch of the front face thereof. In these drawings, reference numeral 122 denotes a recording head. The recording head 122 has a first insulative matrix 133 that is tapered toward the top thereof. A second insulative matrix 134 is spaced from and provided with respect to the first insulative matrix 133 so as to be opposed thereto. The second insulative matrix 134 has a tapered section 135 formed at the tip end thereof. The above-described first and second insulative matrices are formed of, for example, plastic, glass, ceramic, etc. A plurality of discharge electrodes 122*b* that function as unit for forming an electrostatic field at the discharge portion are provided on the upper surface portion 136 which forms an acute angle with respect to the tapered section 135 of the above-described second insulative matrix 134. The tip end portions of these plural discharge electrodes 122*b* extend in the vicinity of the tip end of the above-described upper surface 136, and the tip end portions further protrude forward from the above-described first insulative matrix 133, and form the discharge portions. An ink inflow channel 137 is formed between the above-described first and second insulative matrices 133 and 134 as unit for feeding ink to the above-described discharge portion, and an ink collection channel 138 is formed on the lower side of the above-described second insulative matrix 134. The discharge electrodes 122*b* are formed, as described above, by a publicly known method using a conductive material such as aluminum, nickel, chrome, gold, and/or platinum on the second insulative matrix 134. The individual electrodes 122*b* are constructed so that these are electrically insulated from each other. It is preferable that an amount of the tip end of the discharge electrode 122*b* protruding from the tip end of the insulative matrix 133 is 2 mm or less. The reason why the amount of protrusion is limited in the above-described figure resides in that, if the amount of protrusion is excessive, an ink meniscus does not reach the tip end of the discharge portion, the discharge of ink becomes difficult, and the recording frequency is lowered. Also, it is preferable that the spacing between the above-described first and second insulative matrices 133 and 134 is in a range from 0.1 through 3 mm. A reason why the spacing is set in the above-described range resides in that, if the spacing is too narrow, it becomes difficult for ink to be fed or discharged, and the recording frequency is lowered, and if the spacing is too wide, the meniscus is not stabilized to cause the ink discharge to become unstable. The above-described discharge electrode 122*b* is connected to the image data calculation controlling portion 121, wherein by applying voltage to the discharge electrode on the basis of image information when carrying out recording, ink on the corresponding discharge electrode is discharged, and images are plotted on a printing medium (not illustrated) disposed so as to oppose the discharge portion. The opposite side of the ink drop discharge direction of the above-described ink inflow channel 137 is connected to ink feeding unit of an ink feeding unit (not illustrated). A packing 139 is provided so as to oppose, with spacing, the opposite side of the plane where the discharge electrode of the above-described second insulative matrix 134 is formed. An ink collection channel 138 is provided between the plane and the packing 139. It is preferable that the spacing of the above-described ink collection channel is 0.1 mm or more. The reason why the spacing is limited to the above-described figure resides in that, if the spacing is too narrow, it is difficult to collect ink, and ink leakage occurs. Also, the above-described ink collection channel 138 is connected to ink collection unit of the ink feeding unit (not illustrated). Where uniform ink flow is required in the discharge portion, grooves 140 may be additionally provided between the discharge portion and the above-described ink collection channel. FIG. 13 shows a rough sketch of the front side in the vicinity of the ink discharge portion of the recording head, wherein a plurality of grooves 140 are provided from the vicinity of the boundary with the discharge electrode 122*b* toward the ink collection channel 138 on the tapered section of the second insulative matrix. These grooves 140 are juxtaposed in a plurality in the array direction of the above-described discharge electrode 122*b*, and have a function by which a fixed amount of ink existing in the vicinity of the tip end of the discharge portion is introduced from the opening portion at the discharge portion 122*b* side in response to the opening diameter thereof by capillarity and the introduced ink is delivered to the ink collection channel 138. Therefore, the grooves 140 have a function of forming an ink flow having a fixed thickness of ink liquid in the vicinity of the tip end of the discharge electrode. The shape of these grooves 140 may be such that the capillarity can function. In particular, it is preferable that the shape is 10 through 200 $\mu$m wide and is 10 through 300 $\mu$m deep. The grooves 140 may be provided as necessary, so that a uniform ink flow can be formed on the entire circumference of the head.

It is preferable that the width of the tip end of the discharge electrode 122*b* is as slender as possible in order to carry out formation of high-quality images. The detailed figures are such that the width of the tip end normally is in a range from 5 through 100 $\mu$m although figures differ on the basis of application voltage and physical properties of ink.

Figure 14:
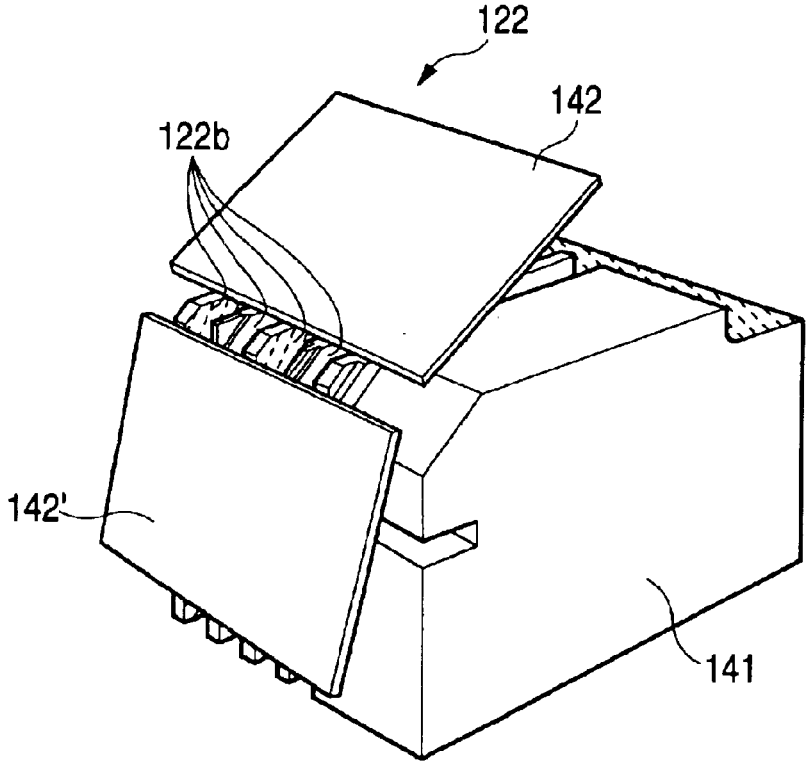
FIG. 14 is an outline view showing only a part of the example of the recording head.
Figure 15:
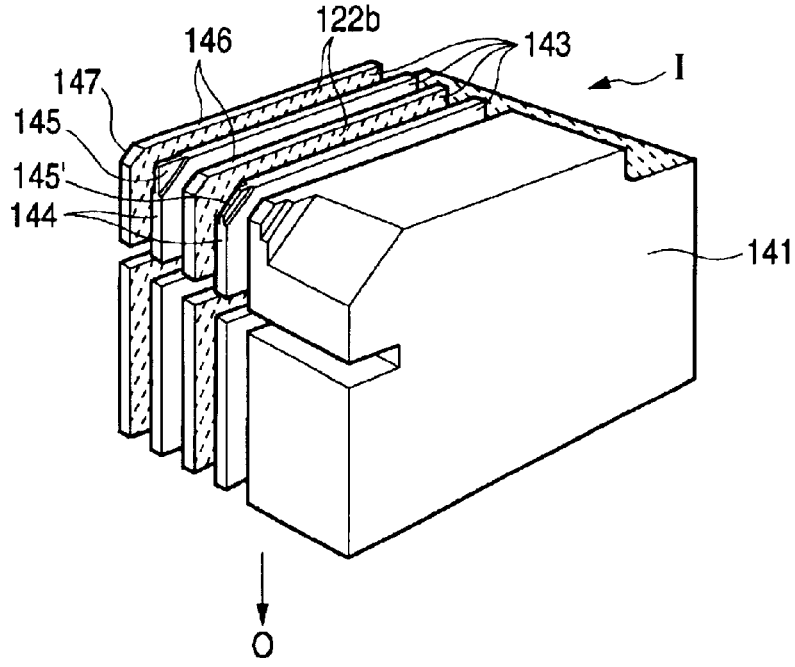
FIG. 15 is an outlined view in which regulating plates 142 and 142' are removed from the recording head shown in FIG. 14.

Also, FIG. 14 and FIG. 15 show another example of the recording head which is used to embody the invention. FIG. 14 is an outlined view showing only a part of the head for description. The corresponding recording head 122 is comprised of a head body 141, which is composed of an insulative material such as plastic, glass, ceramics, etc., as shown in FIG. 14, and meniscus regulating plates 142, 142'. In the drawing, reference numeral 122*b* is a discharge electrode to apply voltage in order to form an electrostatic field at the discharge portion, Further, a detailed description is given of the head body with reference to FIG. 15 in which the meniscus plates 142 and 142' are removed from the head. The head body 141 is provided with a plurality of ink grooves 143 to circulate ink perpendicularly to the edge of the head body. The shape of the ink grooves 143 is set in such a range where capillarity can function, in order to form uniform ink flows. However, it is particularly preferable that the width thereof is 10 through 200 $\mu$m and depth thereof is 10 through 300 $\mu$m. The discharge electrode 122*b* is provided in the respective ink grooves 143. The discharge electrode 122*b* may be provided on the entire surface of the ink grooves 143 or a partial surface thereof by a publicly known method similar to that in the embodiment example of the above-described apparatus, using a conductive material such as aluminum, nickel, chrome, gold, and/or platinum on the head body 141 composed of an insulative material. The discharge electrodes are electrically insulated from each other. Two ink grooves adjacent to each other form one cell, and discharge portions 145 and 145' are provided at the tip end portion of a partitioning wall 144 located at the center thereof. The partitioning plate at the discharge portions 145 and 145' is made thinner than the other partitioning wall portion 144, and is made sharp. Such a head body is produced by a publicly known method such as machining, etching or molding, etc., of an insulative material block. The thickness of the partitioning wall at the discharge portions is preferably 5 through 100 $\mu$m, and it is preferable that the curvature radius of the radicalized tip end is in a range from 5 to 50 $\mu$m. Also, the tip end thereof may be slightly rounded as in the discharge portion 145'. In the drawing, only two cells are illustrated. The cells are partitioned by a partitioning wall 146, and the tip end portion 147 thereof is rounded so that the tip end portion 147 is retreated by the discharge portions 145 and 145'. Ink is caused to flow from direction I through ink grooves to the head by ink feeding unit of the ink feeding unit (not illustrated), and ink is supplied to the discharge portion. Further, surplus ink is collected in direction O by ink collecting unit (not illustrated). As a result, fresh ink is always supplied to the discharge portions. In this state, by applying voltage to the discharge electrode in response to image information, ink is discharged from the discharge portion to the image plotting drum (oppossed drum) (not illustrated), which is provided in a fashion of being opposed to the discharge portion, and with the surface of which a printing medium is brought into contact, wherein images are formed on the printing medium.

Figure 16:
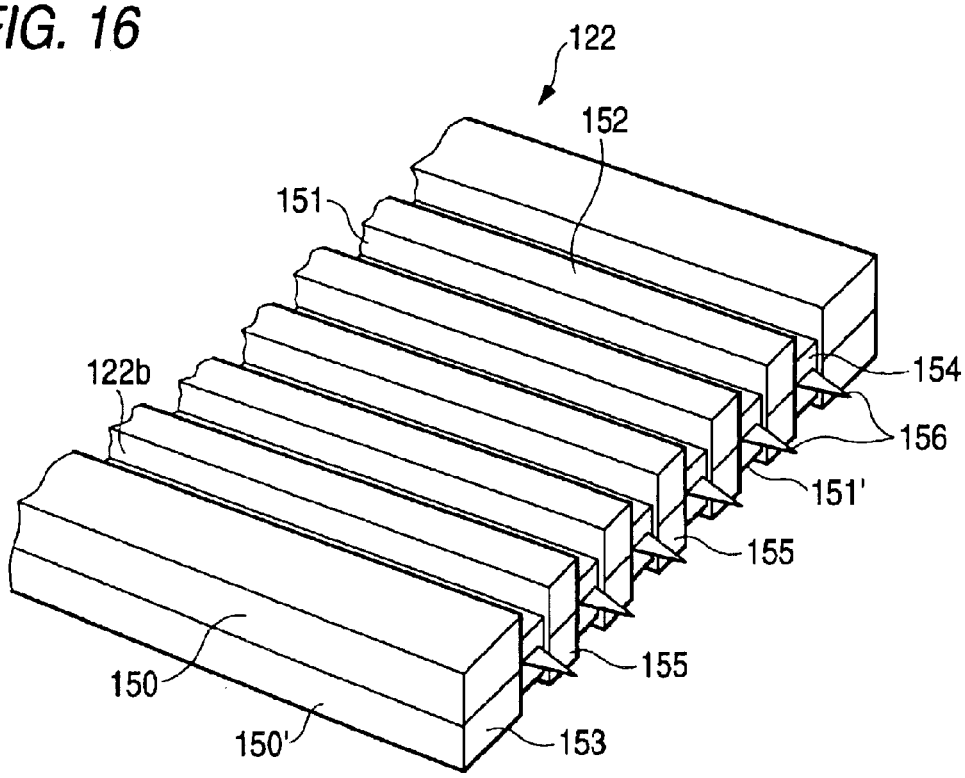
FIG. 16 is an outlined view showing another embodiment of the recording head.

Further, a description is given of still another example of the recording head, using FIG. 16. As shown in FIG. 16, the recording head 122 has a pair of roughly rectangular plate-shaped supporting members 150 and 150'. These supporting members 150 and 150' are formed of plate-like plastic, glass, ceramics, etc., 1 through 10 mm thick, which has an insulation property. A plurality of rectangular grooves 151 and 151' extending parallel to each other on the basis of recording resolution power are formed on one side thereof. It is preferable that the respective grooves 150 and 151' are 10 through 200 μm wide and 10 through 300 μm deep, and a discharge electrode 122*b* is formed on the entire surface of the inside thereof or a partial surface thereof. Since a plurality of grooves 151 and 151' are thus formed on one side of the supporting members 150 and 150', a plurality of rectangular partitioning plates 152 are necessarily provided between the respective grooves 151. The respective supporting members 150 and 150' are combined so that the sides where no groove 151 or 151' is formed are opposed to each other. That is, the recording head 122 has a plurality of grooves to circulate ink on the outer circumferential surface thereof. The grooves 151 and 151' that are formed on the respective supporting members 150 and 150' are linked together so that these are caused to correspond to each other one to one via the rectangular portion 154 of the recording head 122, and the rectangular portion 154 to which the respective grooves are linked is retreated by an appointed distance (50 through 500 .mu.m) from the upper end 153 of the recording head 122. That is, the upper ends 155 of the respective partitioning walls 152 of the supporting members 150 and 150' are provided at both sides of the respective rectangular portions 154 so that these protrude from the rectangular portions 154. And, a guide protrusion 156 composed of an insulative material as described above is provided so as to protrude from the respective rectangular portions 154, thereby forming a discharge portion. Where ink is circulated in the recording head 122 constructed as described above, ink is fed to the respective rectangular portions 154 via respective grooves 151 that are formed on the circumferential surface of one supporting member 150 and is delivered via respective grooves 151' that are formed at the opposite side supporting member 150'. In this case, in order to ensure smooth circulation of ink, the recording head 122 is inclined at an appointed angle. That is, the recording head 122 is inclined so that the supply side (supporting member 150) of ink is positioned upwards and the delivery side (supporting member 150') thereof is positioned downwards. Thus, as ink is circulated in the recording head 122, ink passing through the respective rectangular portions 154 comes out along respective protrusions 156, thereby forming an ink meniscus in the vicinity of the rectangular portion 154 and protrusion 156. And, since voltage is applied, on the basis of image information, to the discharge electrode 122*b* with respect to an image plotting drum (not illustrated), which is provided so as to oppose the discharge portion, and with the surface of which a printing medium is brought into contact, in a state where independent ink menisci are formed at the respective rectangular portions 154, ink is discharged from the discharge portion, and images are formed on the printing medium. Also, where a cover to cover up the groove is provided on the outer circumferential surface of the respective supporting members 150 and 150', a pipe-like ink flow channel is formed along the outer circumferential surface of the respective supporting members 150 and 150', whereby ink may be forcibly circulated by the ink flow channel. In this case, it is not necessary for the recording head 122 to be inclined.

The recording head 122 described in FIG. 10 through FIG. 16 is cleaned in order to maintain satisfactory image plotting conditions. For example, where a pause is continued, or where any problem occurs in the image quality, the tip end of the recording head is cleaned by wiping off the tip end with a brush or cloth having pliability, circulating only an ink solvent, absorbing the discharge portion while feeding or circulating only an ink solvent, placing the recording head in a cover filled with ink solvent vapor in order to prevent ink from being solidified, cooling the head portion to suppress evaporation of an ink solvent, and further, where the recording head is heavily stained, forcibly absorbing ink from the discharge portion, forcibly supplying a jet of air, ink or ink solvent through the ink flow channel, and applying ultrasonic waves with the head immersed in an ink solvent, etc., and these processes may be carried out individually or in combination.

Next, a description is given of a printing medium used for the invention.

Wood-free paper that is normally used as printing paper, slightly coated paper, coated paper, etc., may be listed as printing media. Also, for example, polyolefin laminated paper having a resin film layer on the surface thereof, and plastic film, for example, polyester film, polystyrene film, vinyl chloride film, polyolefin film, etc., may be used. In addition, plastic film, other coated paper, on the surface of which metal is deposited or a metallic foil is adhered, may be used. As a matter of course, paper or film exclusive to ink jet use may be used.

Next, a description is given of oil-based ink that is used in the invention.

Oil-based ink used in the invention is such that at least coloring droplets are disposed in a non-aqueous solvent whose inherent electric resistance is $10^9$ Ωcm or more, and dielectric constant is 3.5 or less.

Preferably, linear or divergent aliphatic hydrocarbon, alicyclic hydrocarbon, or aromatic hydrocarbon, and halogen substitution products of these hydrocarbons may be listed as a non-aqueous solvent, used in the invention, whose inherent electric resistance is $10^9$ Ωcm or more, and dielectric constant is 3.5 or less. For example, hexane, butane, octane, isooctane, decane, isodecane, decalin, nonane, dodecune, isododecane, cyclohexane, cyclooctane, cyclodecane, benzene, toluene, xylene, mesitylene, Isobar-C, Isobar-E, Isobar-G, Isobar-H, Isobar-L (Isobar: Brand name of Exxon Corporation), Shellzol 70, Shellzol 71 (Shellzol: Brand name of Shell Oil), Amsco OMS, Amsco 460 solvents (Amsco: Brand name of Spirits Corporation), Silicone oil, etc., may be individually used or blended for use. Also, the upper limit of the inherent electric resistance of such non-aqueous solvents is $10^{16}$ Ωm or the like, and the lower limit of the dielectric constant is 1.9 or the like.

The reason why the electric resistance of a non-aqueous solvent used is set in the above-described range resides in that, if the electric resistance is lowered, it becomes difficult for concentration of the coloring droplets to occur, wherein the color of formed dots becomes pale, or blur occurs. A further reason why the dielectric constant is set in the above-described range resides in that, it the dielectric constant is increased, the electric field is relieved due to polarization of solvents, and discharge of ink is worsened.

Coloring droplets dispersed in the above-described non-aqueous solvent may be such that coloring materials are disposed in a non-aqueous solvent as dispersing agents, or may be contained in dispersing resin droplets in order to improve the fixation property. Where the coloring agents are contained in the resin droplets, such a method in which pigments, etc., are coated by a resin material of dispersing resin droplets, and are made into resin-coated droplets is generally carried out. In addition, with respect to dyes, such a method in which dispersing resin droplets are colored and are made into colored droplets is generally carried out.

If the coloring material is an oil-based ink composition or a pigment or dye, which is used for a liquid developing agent for electrostatic photography, any type thereof may be used.

Inorganic or organic pigments, which are generally used in the technical field of printing, may be used as the pigments. In detail, for example, publicly known pigments conventionally used, such as carbon black, cadmium red, molybdenum red, chrome yellow, cadmium yellow, titanium yellow, chrome oxide, viridian, cobalt green, ultra marine blue, bluecyan blue, cobalt blue, azo-based pigments, phthalocyanine-based pigments, quinacridon-based pigments, iso-indolinone-based pigments, dioxadine-based pigments, indanthrene-based pigments, perylene-based pigments, perynone-based pigments, tio-indigo-based pigments, kenophthalone-based pigments, metal chelate pigments may be used without any special limitation provided.

Oil-soluble dyes such as azo dyes, metal chelate dyes, naphtol dyes, anthraquinone dyes, indigo dyes, carbonium dyes, quinone imine dyes, xanthene dyes, aniline dyes, quinoline dyes, nitro dyes, nitroso dyes, benzoquinone dyes, naphthoquinone dyes, phthalocyanine dyes, metal phthalocyanine dyes, etc., are favorable as the dyes.

These pigments and dyes may be individually used or may be used in combinations thereof as necessary. However, it is preferable that the content ratio thereof is in a range from 0.5 through 5% by weight with respect to the total weight of ink.

These coloring agents may be dispersed in a non-aqueous solvent as dispersing droplets separately from the dispersing resin droplets, or may be contained in the dispersing resin droplets. Where the coloring agents are contained therein, a method in which pigments, etc., are coated with a resin material of the dispersing resin droplets, and are made into resin coated droplets, is generally carried out. Also, a method in which dyes, etc., are made into coloring droplets by coloring the surface portions of the dispersing resin droplets is generally carried out.

It is preferable that dispersing resin droplets to improve the fixation property of images after printing are contained along with the above-described coloring droplets in oil-based ink used for the invention.

It is favorable that the resin droplets dispersed in the above-described non-aqueous solvent are solid when temperature is 35° C. or less, and hydrophobic resin droplets having favorable affinity with a non-aqueous solvent. Further, resin (P) whose glass transition point is −5° C. through 110° C. and softening point is 33° C. through 140° C. is favorable. Preferable still, the glass transition point is 10° C. through 100° C. or the softening point is 38° C. through 120° C. Still further preferable, the glass transition point is 15° C. through 80° C. or the softening point is 38° C. through 100° C.

By using resin having such a glass transition point and softening point, the affinity between the surface of a printing medium and resin droplets is increased, and bondage of the resin droplets on the printing medium is intensified. Therefore, coherence between an image portion and the surface of a printing medium is increased, wherein resistance against rubbing-off is improved. To the contrary, if the glass transition point or the softening point are lowered below or increased beyond the above-described range, the affinity between the surface of a printing medium and resin droplets is lowered, and bondage of the resin droplets is weakened.

The mean average molecular weight Mw of the resin (p) is $1\times10^3$ through $1\times10^6$, preferably $5\times10^3$ through $8\times10^5$, and further preferably $1\times10^4$ through $5\times10^5$.

In detail, the following may be listed as such a resin (P). That is, olefin polymer and copolymer (for example, polyethylene, poylptopyrene, polyisobuthylene, ethylene-vinyl acetate copolymer, ethylene-acrylate copolymer, ethylene-methacrylate copolymer, ethylene-methacrylic acid copolymer, etc.), vinyl chloride polymer and copolymer (for example, polyvinyl chloride, vinyl chloride-vinyl acetate copolymer, etc.), vinylidene chloride copolymer, vinyl alkanate polymer, and copolymer, acrylic alkanate polymer and copolymer, polymer and copolymer of styrene and its derrivatives (for example, butadiene-styrene copolymer, isobuthylene-styrene copolymer, styrene-methacrylate copolymer, styrene-acrylate copolymer, etc.), acrylonitrile copolymer, methacrylonitrile copolymer, alkylvinylether copolymer, acrylic ester polymer and copolymer, methacrylic ester polymer and copolymer, diester itaconate polymer and copolymer, maleic anhydride copolymer, acrylic amide copolymer, methacrylic amide copolymer, phenol resin, alkide resin, polycarbonate resin, ketone resin, polyester resin, silicone resin, amide resin, hydroxyl and carboxyl modified polyester resin, butyral resin, polyvinyl acetal resin, urethane resin, rosin-based resin, hydrogen-added rosin resin, petroleum resin, hydrogen-added petroleum rein, maleic acid resin, terpene resin, hydrogen-added terpene resin, cumarone-indene resin, cyclized rubber-methacrylic ester copolymer, cyclized rubber-acrylic ester copolymer, copolymer containing heterocycle not including nitrogen atoms (heterocycle is, for example, a furan ring, tetrahidrofuran ring, thiophene ring, dioxane ring, dioxofuran ring, lactone ring, benzofuran ring, benzothiophene ring, 1,3-dioxetane ring, etc.), epoxy resin, etc.

It is preferable that the total content of coloring droplets and resin droplets, which are dispersed in oil-based ink according to the invention, is 0.5 through 20% by weight with respect to the total amount of ink. If the content thereof is reduced, suchproblems are likely to occur, that is, the printing image density becomes short, wherein it becomes difficult for affinity between ink and the surface of a printing medium to be obtained, and no resolute image can be obtained. On the other hand, if the content is increased, such problems are likely to occur, that is, it becomes difficult to obtain uniform dispersed liquid, wherein ink flow in the recording head does not become uniform, and no stabilized ink discharge can hardly be obtained.

It is preferable that a coloring agent is contained in the oil-based ink used for the invention as a coloring constituent to check a finished plate along with the above-described dispersed resin droplets.

Either of oil-based ink compositions, or pigments or dyes, which have conventionally been used for an electrostatic photography liquid developing agent may be used as the coloring agent.

It is preferable that the mean droplet size of the coloring droplets and resin droplets, which are dispersed in a non-aqueous solvent according to the invention, is 0.05 through 5 μm, further preferably, 0.1 through 1.5 μm, still further preferably, 0.4 through 1.0 μm. These droplets sizes are obtained by CAPA-500 (Product name of Horiba, Ltd.).

Non-aqueous dispersing coloring agents used in the invention may be produced by an already publicly known mechanical method or polymerization granulating method in prior arts. The mechanical crushing methods are, for example, a method according to which, as necessary, coloring agents and resin are directly ground by a conventionally known crushing machine after being blended, melted, and mixed, are made into particles, and are further dispersed by a wet type dispersing machine (for example, a ball mill, paint shaker, kady mill, dyno mill, etc.), and a method according to which pigment materials, which become coloring droplet constituents, and dispersion-assisting polymer (or coating polymer) are ground after being blended in advance and made into a blended substance, and are dispersed with a dispersion polymer coexisting. In detail, a method for production of paints or liquid developing agents for electrostatic photography may be used. These are described in the publications, of "FLUIDITY OF PAINTS AND DISPERSION OF PIGMENTS" edited and translated by Kenji Ueki and published by Kyoritu Shuppan (1971), "SCIENCE OF PAINTS" written by Solomn and published by Hirokawa Shoten (1969), "COATING TECHNOLOGY" written by Yuji Harasaki and published by Asakura Shoten (1971), and "FUNDAMENTAL SCIENCE OF COATING" written by Yuji Harasaki and published by Maki Shoten (1977), etc.

There is another method of producing coloring droplets by coloring resin droplets granulated by the polymerization granulating method by dyes. A conventionally known non-aqueous dispersion polymerization method may be listed as the polymerization granulating method. In detail, the method is described in the publications of "NEWEST TECHNOLOGY OF ULTRA PARTICLE POLYMER" (2nd Chapter) edited by Souichi Muroi and published by CMC Shuppan (1991), "RECENT ELECTROPHOTOGRAPHY DEVELOPMENT SYSTEM, DEVELOPMENT AND APPLICATION OF TONER MATERIALS" (3rd chapter) written by Kouichi Nakamura and published by Nippon Kagaku Information, Ltd. (1985), and "DISPERSION POLYMERIZATION IN ORGANIC MEDIA" written by K. E. J. Barrett and published by John Wiley (1975), etc.

Normally, in order to disperse and stabilize dispersing droplets in a non-aqueous solvent, a dispersing polymer is concurrently used. The dispersing polymer contains a soluble repetition unit in a non-aqueous solvent as a main constituent, and it is preferable that the mean molecular weight is $1\times10^3$ through $1\times10^6$ in terms of the mean molecular weight Mw, and further preferably $5\times10^3$ through $5\times10^5$.

Polymerization constituents expressed by the following general expression 1 may be listed as a favorable soluble repetition unit of the dispersing polymer used for the invention;

Expression 1

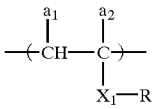

In the above-described general expression 1, $X_1$ expresses —COO—, —OCO— or —O—.

R expresses alkyl groups or alkenyl groups whose carbon number is 10 through 32, and preferably expresses alkyl groups or alkenyl groups whose carbon number is 10 through 22. These may be linear or bifurcated. Non-substituted groups are favorable, but substitution groups may be used.

In detail, decyl group, dodecyl group, tridecyl group, tetradecyl group, hexadecyl group, octadecyl group, eicosanyl group, dochosanyl group, decenyl group, dodecenyl group, tridecenyl group, hexadecenyl group, octadecenylgroup, rinorenylgroup, renolenylgroup, etc., may be listed.

$a_1$ and $a_2$ may be the same or may differ from each other. These express a hydrogen atom, halogen atom (for example, chlorine atom, bromine atom, etc.), cyano group, alkyl groups whose carbon number is 1 through 3 (for example, methyl group, ethyl group, propyl group, etc.), and —COO—$Z_1$ or —$CH_2$COO-$Z_1$ [$Z_1$ expresses a hydrocarbon group, whose carbon number is 22 or less which may be substituted (for example, alkyl group, alkenyl group, aralkyl group, alicyclic group, aryl group, etc.)].

Favorable hydrocarbon groups of hydrocarbon groups expressed in terms of $Z_1$ are alkyl groups whose carbon number is 1 through 22, which may be substituted (for example, methyl group, ethyl group, propyl group, butyl group, hexyl group, pepthyl group, octyl group, nonyl group, decyl group, dodecyl group, tridecyl group, tetradecyl group, hexadecyl group, octadecyl group, eicosanyl group, docosanyl group, 2-chloroehtyl group, 2-promoethyl group, 2-cyanoethyl group, 2-methoxycarbonylethyl group, 2-methoxyehtyl group, 3-bromopropyl group, etc.), alkenyl groups whose carbon number is 4 through 18, which may be substituted (for example, 2-methyl-1-propenyl group, 2-butenyl group, 2-pentenyl group, 3-methyl-2-pentenyl group, 1-pentenyl group, 1-hexenyl group, 2-hexenyl group, 4-methyl-2-2hexenyl group, decenyl group, dodecenyl group, tridecenyl group, hexadecenyl group, octadecenyl group, renolenyl group, etc.) alalkyl groups whose carbon number is 7 through 12, which may be substituted (for example, benzil group, phenethyl group, 3-phenylpropyl group, naphthylmethyl group, 2-naphthylethyl group, chlorobenzil group, bromobenzil group, methylbenzil group, ethylbenzil group, methoxybenzil group, dimethylbenzil group, dimethoxybenzil group, etc.), alicylic groups whose carbon number is 5 through 8, which may be substituted (for example, cyclohexyl group, 2-cyclohexylethyl group, 2-cyclopentylethyl group etc., and aromatic groups whose carbon number is 6 through 12, which may be substituted (for example, phenyl group, naphthyl group, trill group, xelyl group, propylphenyl group, buthylphenyl group, octylphenyl group, dodecylphenyl group, methoxyphenyl group, ethoxyphenyl group, buthoxyphenyl group, decyloxyphenyl group, chlorophenyl group, dichlorophenyl group, bromophenyl group, cyanophneyl, acetylphenyl group, methoxycarbonylphenyl group, ethoxycarbonylphenyl group, buthoxycarbonylphenyl group, acetamidephenyl group, propionamidephneyl group, dodecyroilamidephenyl group, etc.)

The dispersing polymer may contain other repetition units along with the repetition units expressed in General Expression 1 as copolymerization constitutents. The other copolymerization constituents may be any compound if these are composed of monomers which are copolymerizable with monomers corresponding to the repetition units of the general expression 1.

The ratio of existence of polymer constituents, which is expressed by General Expression 1 in the dispersing polymer, is preferably 50% by weight or more, and further preferably 60% by weight or more.

Dispersion-stabilizing resin (Q-1), etc., may be listed as a detailed example of these dispersing polymers. Also, an article which is available on the market (Solvlen 1205 produced by Asahi Kasei. Co., Ltd.) may be used.

It is preferable that the dispersing polymers are added in advance when carrying oat polymerization when producing the above-described resin (P) droplets as a dispersing substance (Latex).

The adding amount of the dispersing polymers is set to 1 through 50% by weight with respect to the resin (P) for granulation.

The coloring droplets (or coloring material droplets) and dispersing resin droplets in oil-based ink according to the invention are preferably charge-detecting droplets of positive or negative charge.

In order to provide these droplets with a charge detecting property, this can be achieved by adequately utilizing a technology for a wet-type electrostatic photography developing agent. In detail, a charge detecting material and other additives such as a charge regulating agent, which is described in the above-described "RECENT ELECTROPHOTOGRAPHY DEVELOPMENT SYSTEM, DEVELOPMENT AND APPLICATION OF TONER MATERIALS", Pages 139 through 148, "FUNDAMENTALS AND APPLICATION OF ELECTROCPHOTOGRAPHY", Pages 497 through 505, which is edited by the Electrophotography Society (published by Corona Corporation, 1988), and "Electrophotography" 16 (No.2), Pages 44, written by Yuuji Harasaki (1977), etc., may be used.

In detail, these are disclosed by, for example, British Patent Nos. 893429, 934038, 1122397, U.S. Pat. Nos. 3,900,412, 4,606,989, Japanese Patent Publication Nos. 60-179751, 60-185963, and 2-13965.

It is preferable that such a charge regulating agent is added by 0.001 through 1.0 parts by weight with respect to a dispersing agent, which is a carrier liquid, of 1000 parts by weight. Further, various types of additives may be added as necessary. However, the upper limit of the total amount of these additives is regulated by electric resistance of the oil-based ink. That is, since it becomes difficult to obtain good-quality continuous graduation images if the inherent electric resistance of ink becomes lower than $10^9$ Ωcm in a state where the dispersing droplets are removed, it is highly recommended that the adding amount of the respective additives is controlled within the limit.

Embodiments

Hereinafter, a detailed description is given of the invention with reference to the embodiments described below. However, the present invention is not limited to these embodiments.

First, production examples of ink resin droplets (PL-1) are shown below.

PRODUCTION EXAMPLE 1

Production of Resin Droplets (PL-1)

A blended solution of 10 grams of a dispersion-stabilizing resin (Q-1) of the following structure, 100 grams of vinyl acetate and 384 grams of Isobar-H were heated to a temperature of 70° C. while being agitated in a nitrogen atmosphere. 0.8 grams of 2,2'-azobis (isobalenitrile) (which is simply called "A.I.V.N.) was added as a polymerization initiator, Then, these substances were reacted for three hours. White turbidness occurred in 20 minutes after the initiator was added. The reaction temperature reached88° C. Further, after 0.5 grams of the initiator was added and these substances were subjected to a reaction for two hours, the temperature was increased to 100° C. and agitation was carried out for two hours, wherein non-reacted vinyl acetate was eliminated. After the blended solution was screened by a 200-mesh nylon cloth after cooling, the obtained white dispersed substances were latex of single dispersibility, whose polymerization ratio is 90% and mean droplet size is 0.23 μm. The droplet size thereof was measured by CAPA-500 (manufactured by Horiba, Ltd.) Expression 2.

Dispersion-stabilizing Resin (Q-1)

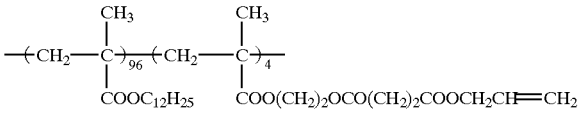

(Figures are Based on the Ratio by Weight)

A part of the white dispersed substance was subjected to centrifugal separation (Number of revolutions is $1\times10^4$ r.p.m, time of revolutions is 60 minutes), and sedimentary resin droplets were collected and dried. The mean molecular weight (Mw: Polystylene-converted GPC value) of the resin droplets was $2\times10^5$, and glass transition point (Tg) was 38° C.

Next, oil-based ink was produced.

Oil-based Ink (IK-1)

10 grams of dodecylmethacrylate/acrylic acid copolymer (copolymerization ratio: 95/5 ratio by weight), 10 grams of nigrosin and 30 grams of Shellsol 71 were placed in a paint shaker (Toyo Seiki Corp.) along with glass beads and were dispersed for four hours, wherein fine dispersed substances of nigrosin were obtained.

30 grams (in view of solid content weight) of resin droplets (PL-1), which is Production example 1 of ink resin droplets, 20 grams of the above-described nigrosin, 15 grams of FOC-1400 (Nissan Kagaku Corp., tetradecylalkohol), and 0.08 grams of octadecene-half maleic acid octadecylamide copolymer were diluted with one liter of Isobar-G, thereby producing black oil-based ink.

Next, two liters of the oil-based ink (IK-1), which was thus produced as described above, was filled in an ink tank an ink jet recording unit of an image plotting unit of a printing press shown in FIG. 1. Herein, a full-line head of 900 dpi of such a type as shown in FIG. 12 was used as the recording head. A dump-in heater and impeller blades were provided in the ink tank as ink temperature controlling unit, and then the ink temperature was set to 30° C. And, the temperature was controlled by a thermostat while turning the impeller blades at 30 r.p.m. Herein, the impeller blades were used as agitating unit for preventing sedimentation and coagulation. Further, a part of the ink flow channel is made transparent, an LED, light emitting element, and an optical detection element were placed so as to place the part therebetween, wherein the concentration of the ink was controlled by adding a dilution liquid (Isobar-G) of ink or a concentration ink (in which the solid density of the above-described IK-1 ink was doubled) on the basis of the output signals thereof. Roll-shaped slightly coated paper was provided on the opposed drum as a printing medium and was transferred. After dust and foreign matter existing on the surface of the printing medium was removed by an adhesive roller, the recording head approached the printing medium and was placed at the image plotting position, and image data to be printed were transmitted to an image data calculation controlling portion, wherein oil-based ink was discharged from a full-line multi-channel head while transferring the printing medium by rotations of the opposed drum to form an image. At this time, the tip end width of the discharge electrode of the ink jet head was set to 10 μm, and the distance between the head and the printing medium was maintained at 1 mm by an output of an optical gap detector. 500V pulse voltage was further overlapped when discharging ink, with 2.5 kv voltage constantly applied as a bias voltage, and by changing the pulse voltage in 256 steps in a range from 0.2 milliseconds to 0.05 milliseconds, image depiction was carried out while changing dot areas. At this time, the adhesive force of the adhesive roller was set to 7 hPa or more but 180 hPa or less (Example 1), 4 hPa or more but 7 hPs or less (Example 2), 180 hPa or more but 25 hPa or less (Example 3), 4 hPa or less (Comparison control 1), and 250 hPa or more (Comparison control 2). As a result, in Example 1, almost all of the dust and foreign matter adhered to the printing medium could be adsorbed and removed by the adhesive roller, wherein the recording head was subjected to almost no trouble such as clogging thereof, and a clear image free from any breakage of the printing medium could be obtained. Also, in Example 2, dust and foreign matter remained slightly on the printing medium. However, almost no problem occurred. Further, in Example 3, wrinkles could be slightly observed on the printing medium in some printing conditions. However, there was almost no problem in actual applications. In addition, no image deterioration due to changes in the dot diameter was observed even in changes in atmospheric temperature and an increase in printing time, wherein satisfactory printing could be achieved.

To the contrary, in the Comparison control 1, the adsorption performance of dust and foreign matter was weak, wherein it was impossible to remove dust and foreign matter. Also, in the Comparison control 2, the adsorption between the adhesive roller and the printing medium was too intensive, wherein the printing medium was subjected to wrinkles and was partially broken.

Further, the images were intensified through heating by a Xenon flash fixation unit (produced by Ushio Denki, Ltd., whose light emission intensity was 200 J/pulse). After the printing was completed, the ink jet recording unit was retreated by 50 mm from the position where it approached the image plotting drum, in order to protect the ink jet head.

The obtained printed matter had remarkably clear images which were free from any skipping of dots and blurs on the printed images. Also, after printing was completed, the tip end part of the recording head was immersed in Isobar G and was subjected to a positive direct current of 1 kv for 30 seconds, wherein for three months, it was possible to bring about satisfactory printed matter without any need of maintenance.

An aluminum plate 0.12 mm thick on which sand dressing and anode oxidation treatment are provided was attached, as a plate material, with its top and tail gripped by a mechanical unit secured at the drum of a plate making apparatus. The discharge head approached the image plotting position of the plate material after dust and foreign matter existing on the plate material by absorption of an air pump, and image data to be used for plate making were transmitted to the image data calculation controlling portion, and a 64-channel discharge head was moved while rotating the drum, wherein oil-based ink was discharged on an aluminum plate to form images. At this time, the tip end width of the discharge electrode of the ink jet head was set to 10 $\mu$m, and the distance between the head and the plate material was controlled to become 1 mm by an output from an optical gap detector unit. A pulse voltage of 500V was further overlapped when discharging ink with a bias voltage of 2.5 kV constantly applied, and the images were plotted while changing the dot areas by varying the pulse voltage in 256 steps in a range from 0.2 milliseconds to 0.05 milliseconds.

No defect resulting from dust and foreign matter occurred in the image plotting, and no deterioration of images, which may occur due to changes in the dot diameter in line with an increase in the great number of plates made, could be observed. That is, satisfactory plate making could be achieved.

Further, the images were intensified through heating by a Xenon flash fixation unit (produced by Ushio Denki, Ltd., whose light emission intensity is 200 J/pulse), and a plate was made. In order to protect the ink jet head, the ink jet image plotting unit was retreated by 50 mm from a position close to the drum along with the subscanning unit. Next, the printing plate was picked up from the plate making apparatus, and was attached to an Oliver 266EPZ offset printing press and was used for printing.

Even after 10,000 sheets of paper were printed by the same printing plate, the obtained printed matter was free from any skipping and blur in the printed images.

By immersing the tip end portion of the discharge head in Isobar G after a plate was made and applying a positive direct current voltage of 1 kV thereto for 30 seconds, a printing plate could be obtained, which brought about satisfactory printed matter without any maintenance work for six months.

Hereinafter, a detailed description is given of embodiments of the invention.

The invention is featured in that images are formed on a plate material (printing master plate) by an ink jet method that discharges oil-based ink by electrostatic fields.

In the invention, size of discharged ink drops is determined by the size of the tip end portion of a discharge electrode or conditions of electrostatic field formation. Therefore, it is possible to obtain small ink drops by using a small discharge electrode or adjusting the electrostatic formation conditions without making the discharge nozzle diameter or discharge slit width small. Therefore, it is possible to control minute images without any problem of clogging ink in the head, wherein the invention can provide a plate making method and plate making apparatus, which can produce plates by which a great number of printed matter having clear images can be produced.

A constructional example of a plate making apparatus in which a plate making method according to the invention is carried out is shown below.

Figure 17:
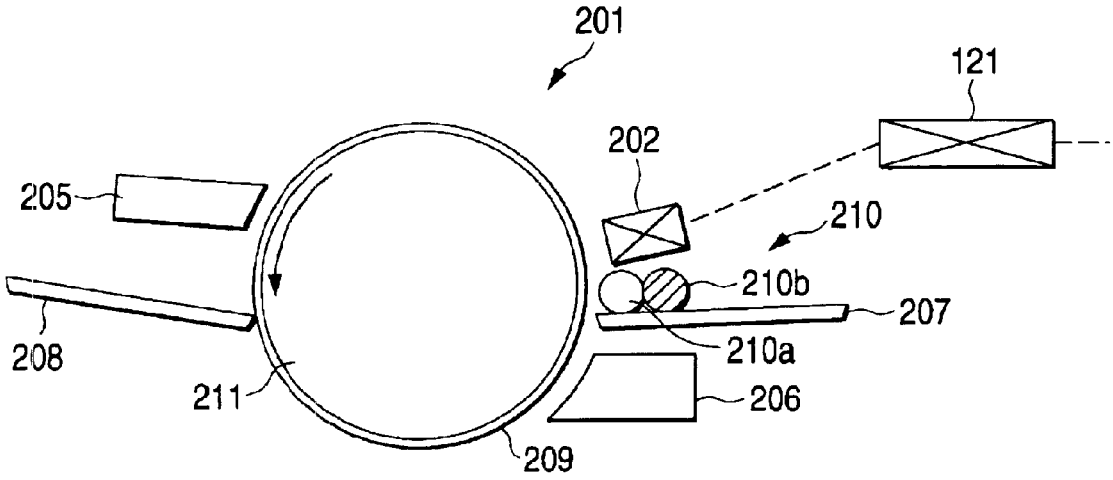
FIG. 17 is an exemplary view showing the entire construction of one example of a plate making apparatus used for the invention.
Figure 18:
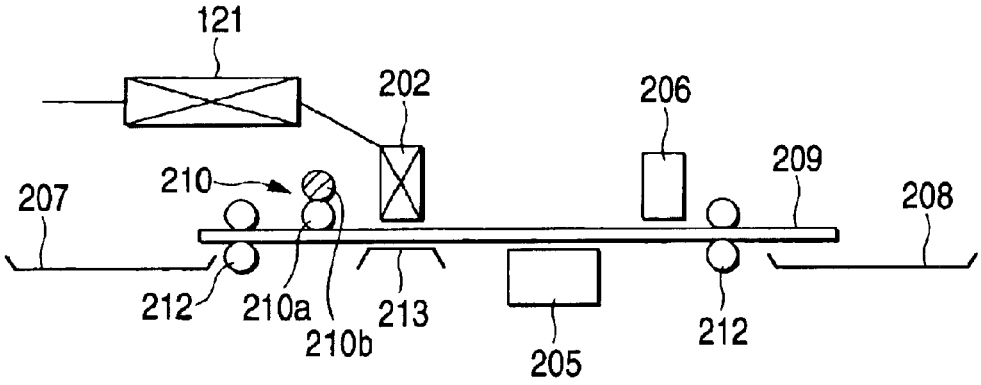
FIG. 18 is an exemplary view showing the entire construction of another example of a plate making apparatus used for the invention.

FIG. 17 and FIG. 18 are views showing the entire construction of the plate making apparatus. FIG. 9 shows a construction example of a control portion, an ink feeding portion, and an image plotting portion including a head contacting and releasing mechanism, of the plate making apparatus. Also, FIG. 10 through FIG. 16 are views to describe an ink jet image plotting unit with which the plate making apparatus shown in FIG. 17 and FIG. 18 is provided.

First, a description is given of a plate making process using the entire constructional view of a plate making apparatus including a structure wherein a plate material is attached to an image plotting drum 211 as shown in FIG. 17. However, the invention is not limited to the following structure.

The drum 211 is normally made of a metal such as aluminum, stainless steel and iron, or plastic or glass. In particular, in the case of a metal-made drum, the surface thereof is frequently coated with, for example, alumite treatment or chrome plating in order to strengthen the wear resistance and rust proof properties thereof. The drum 211 may be provided with a heat insulating material on its surface as described below. Also, it is preferable that the drum 211 has an earthing function as an opposed electrode of a discharge head electrode in the electrostatic field discharge. On the other hand, where the insulation property of a matrix of the plate material is high, it is preferable that a conductive layer is provided on the matrix. In this case, it is preferable that earthing unit is provided on the conductive layer. Further, as described above, where the heat insulating material is provided on the drum 211, image plotting can be facilitated by attaching earthing unit to the plate material. In this case, publicly known unit such as a brush, plate spring, roller, etc., having conductivity may be used.

In addition, the plate making apparatus 201 includes an ink jet image plotting unit 202, by which oil-based ink is discharged onto the plate material 209 attached on the drum 211 to form images.

Also, the plate making apparatus 201 includes a fixation unit 205 to intensify oil-based ink images plotted on the plate material 209. A plate surface desensitizing unit 206 may be used, which is used for the purpose of intensifying the hydrophilicity of the surface of the plate material 209 as necessary.

And, in the plate making apparatus 201, an adhesive roller 210 is disposed at the upstream side in the moving direction of the plate material of the ink jet image plotting unit 202 so as to roll with respect to the plate material 209 in order to adsorb and remove dust and foreign matter existing on the plate material 209. Also, herein, "roll" unit that the adhesive roller 210 moves relative to the plate material 209 while being brought into contact with the plate material 209 and rotating thereon (including driven rotation and self-revolution). In the construction of the present embodiment, the adhesive roller 210 rotates at a fixed position with respect to a turning plate material 209, whereby relative movement between the adhesive roller 210 and plate material 209 is enabled.

An automatic plate feeding unit 207 for automatically feeding a plate material 209 onto the drum 211, and an automatic plate delivery unit 208 for automatically removing the plate material 209 from the drum 211 after image plotting is completed may be installed. Where the automatic plate feeding unit 207 and automatic plate delivery unit 208 are used, plate making operations can be further facilitated, wherein it becomes possible to shorten the plate making time, and an effect of the present invention can be further increased.

With reference to FIG. 17 and a part of FIG. 9, a description is given below of a process for producing printing plates by the plate making apparatus 201.

First, a plate material 209 is attached to the drum 211 by using the automatic plate feeding unit 207. At this time, the plate material 209 is adhered to and fixed on the drum 211 by a mechanical method such as a publicly known plate top and tail gripper unit, air suction unit, or also a publicly known electrostatic method, etc., whereby it is possible to prevent the plate material 209 from being brought into contact with the ink jet image plotting unit 202 when plotting images and being damaged or broken due to flapping of the tail of the plate. Also, where unit for causing the plate material 209 to be adhered to the drum 211 only around the image plotting position of the ink jet image plotting unit 202 is disposed, and the unit is actuated at least when plotting images, it is possible to prevent the plate material 209 from being brought into contact with the ink jet image plotting unit 202. In detail, there are some methods, that is, a method for disposing a press roller at the upstream side or the downstream side of the image plotting position on the drum 211. When not plotting images, it is preferable that the head is released from the plate material, wherein it is possible to effectively prevent a trouble such as the head being brought into contact with or damaged by the ink jet image plotting unit 202.

The image data calculation controlling portion 121 receives image data from an image scanner, a magnetic disk unit, an image data transmission unit, etc., and carries out color decomposition. Further, the controlling portion 121 calculates the decomposed color data for dividing the same into adequate pixels and graduation scales and distributes these data to respective heads.

In addition, since oil-based ink images are made into dots by using an ink jet recording head 122 (discharge head described later, see FIG. 10) that the ink jet recording unit 120 has, the controlling portion 121 calculates dot area ratios.

As described later, the image data calculation controlling portion 121 controls movement of the ink jet heads 122 and the discharge timing of oil-based ink, and at the same time, controls the timing of a printing medium movement.

Calculation data that are inputted into an image data calculation controlling portion 121 are once stored in a buffer. The image data calculation controlling portion 121 rotates the drum 211 and approaches a discharge head 122 to the position close to the drum 211 by the head contacting and releasing unit 231. The distance between the discharge head 122 and the surface of the plate material 209 on the drum 211 is controlled to an appointed distance during plotting images by a mechanical control such as a fitting roller or by controlling the head contacting and releasing unit based on signals from an optical distance detector such distance control can bring about satisfactory plate making without any dot diameter becoming uneven due to floating of the plate material or without any dot diameter changing when a vibration is applied onto the plate making apparatus.

A single channel head, a multi-channel head, or a full-line head may be used as the discharge head 122. Main scanning is carried out by rotations of the plate cylinder (drum) 211. In the case of the multi-channel head or full-line head having a plurality of discharge portions, the array direction of the discharge portions is determined in the axial direction. Further, in the case of the single channel head or multi-channel head, the head 122 is moved in the axial direction of the plate cylinder 211 per rotation of the plate cylinder 211 by the image data calculation controlling portion 121, and oil-based ink is discharged onto the plate material 209 attached to the plate cylinder 211 at the discharge position and dot area ratio, which are obtained by the above-described calculations. Thereby, dotted images are plotted on the plate material 209 with oil-based ink in response to shading of a printing document. This operation is continued until an oil-based ink image corresponding to one color of the printing document is formed on the plate material 209.

On the other hand, in the case where the discharge head 122 is a full-line head having roughly the same length as the width of the plate cylinder, an oil-based ink image equivalent to one color of the printing document is formed on the plate material 209 by one rotation of the plate cylinder, and a master plate is thus produced. By thus carrying out main scanning by revolutions of the plate cylinder, position accuracy in the main scanning direction can be increased, and images can be plotted at a high speed.

Next, in order to protect the discharge head 122, the head 122 is retreated from the position at which the discharge head 122 is close to the drum 211. The contacting and releasing unit operates so that the discharge head is kept away by at least 500 $\mu$m from the drum times other than the time of plotting images. The contacting and releasing action may be composed of a slide type or may move like a pendulum by fixing the discharge head 122 by an arm that is fixed at a certain axis, and moving the arm around the axis. By causing the discharge head 122 to retreat when not plotting images, it is possible to prevent the discharge head 122 from physical breakage or being stained, and a longer service life can be brought about.

A description is given of a constructional example in which subscanning is carried out by causing the plate material 209 to run, with reference to FIG. 18. However, the invention is not limited to the following constructional example.

The plate material 209 is placed between and transferred by two pairs of capstan rollers 212, and images are plotted thereon by the ink jet image plotting unit 202 using data that are calculated and divided into an adequate great number of pixels and graduations by the image data calculation controlling portion 121. It is preferable that earthing unit 213 that becomes an opposed electrode of the discharge head electrode in the electrostatic field discharge is provided at a portion where images are plotted by the ink jet image plotting unit 202, wherein image plotting can be facilitated. On the other hand, where the insulation of the matrix of the plate material 209 is high, it is preferable that a conductive layer is provided on the matrix. In this case, it is preferable that the conductive layer is earthed by publicly known unit having conductivity such as a brush, plate spring, roller, etc.

Also, FIG. 18 shows an apparatus in which a sheet plate material is used. However, a roll-shaped plate material can be favorably used. In this case, it is preferable that a sheet cutter is provided at the upstream side of the automatic plate delivery unit.

Also, the plate making apparatus 201 includes a fixation unit 205 to intensify the oil-based ink images that are plotted on the plate material 209. In addition, a plate surface desensitizing unit 206 that is used for the purpose of intensifying the hydrophilicity of the surface of the plate material 209 may be installed as necessary. Also, in the plate making apparatus 201, the above-described adhesive roller 210 is disposed at the upstream side of the ink jet image plotting unit 202 so as to roll on the plate material 209. In the present embodiment, the adhesive roller 210 is composed of two or more adhesive rollers 210*a* and 210*b* whose adhesive forces are different from each other, wherein one adhesive roller 210*a* is caused to roll on the plate material 209 while the other adhesive roller 210*b* having a greater adhesive force than that of the above-described one adhesive roller 210*a* is brought into contact with the adhesive roller 210*a*. Therefore, dust and foreign matter that are adhered to the adhesive roller 210*a*can be adsorbed and removed by the adhesive roller 210*b*. That is, the adhesive roller 210*b* functions as a cleaning roller to adsorb and remove dust and foreign matter of the adhesive roller 210*a* and also prevents reverse adhering of dust and foreign matter from the adhesive roller 210*a* to the plate material.

Further, it is preferable that an automatic plate feeding unit 207 for automatically feeding plate materials 209 and an automatic plate delivery unit 208 for automatically delivering plate materials 209 after image plotting is completed are provided. By using the automatic plate feeding unit 207 and automatic plate delivery unit 208, plate making operations can be further facilitated. Also, since it is possible to shorten the time required to make a plate, effects of the invention can be further increased.

With reference to FIG. 18 and a part of FIG. 9, a further detailed description is given of a printing plate producing process by the plate making apparatus 201.

First, a printing medium is transferred by capstan rollers 110. At this time, by providing printing medium guiding unit (not illustrated) as necessary, it is possible to prevent the printing medium from being brought into contact with the ink discharge image plotting unit 103 and being damaged or broken due to flapping of the top and/or tail of the printing medium. Unit for preventing a printing medium from slackening only around the image plotting position of the ink discharge image plotting unit is disposed, and the unit is actuated at least when plotting images, whereby the printing medium can be prevented from being brought into contact with the ink discharge image plotting unit. In detail, for example, such a method of disposing a press roller at the upstream side and downstream side of the image plotting position may be available.

In addition, when not plotting images, it is preferable that the head is released from the printing medium, whereby it is possible to prevent any inconvenience from occurring, by which a printing medium is brought into contact with the ink discharge image plotting unit and is damaged or broken.

Image data from a magnetic disk unit, etc., are provided to the image data calculation controlling portion 121 in FIG. 9, and the image data calculation controlling portion 121 calculates a discharge position of oil-based ink in response to the input image data and dot area ratios at the position. These calculation data are once stored in a buffer.

The image data calculation controlling portion 121 controls movement of the ink jet head 122, discharge timing of oil-based ink, and operation timing of the capstan rollers, and at the same time, as necessary, approaches the recording head 122 at a position in the vicinity of the printing medium by a head contacting and releasing unit 131. The distance between the recording head 122 and the surface of a printing medium is maintained at an appointed distance by a mechanical distance control such as butting rollers or control of the head contacting and releasing unit based on signals from an optical distance detector during plotting images. With such distance control, dot diameters are prevented from becoming uneven due to floating of the printing medium, and are not changed even if vibrations are applied to the printing press, wherein satisfactory printing can be carried out.

A single channel head, a multi-channel head or a full-line head may be used as the discharge head 122. Subscanning is carried out by transfer of the plate material 209. In a case of the multi-channel head having a plurality of discharge portions, the arraying direction of the discharge portions is set roughly parallel to the travelling direction of the plate material. Further, in a case of the single-channel head or multi-channel head, the discharge head 122 is moved in a direction orthogonal to the travelling direction of the plate material 209 whenever the plate material is caused to move by the image data calculation controlling portion 121, and oil-based ink is discharged onto the plate material 209 at the discharge position and at the dotted area ratio, which are obtained by the above-described calculation, whereby dotted images responsive to the shading of a printing document are plotted on the plate material 209 with oil-based ink. The operation is continued until oil-based ink images per color of the printing document is formed on the plate material 209 and a plate is completed. On the other hand, in a case where the discharge head 122 is a full-line head having a length roughly equivalent to the width of the plate material 209, the arraying direction of the discharge portion is set in a direction roughly orthogonal to the travelling direction of the plate material, and the plate material 209 is caused to pass through the image plotting portion, oil-based ink images per color of the printing document is formed on the plate material 209 and the plate is thus completed.

In order to protect the discharge head 122, it is preferable that the discharge head 122 is retreated from the position close to the plate material 209. The contacting and releasing unit causes the discharge head to be kept away by at least 500 $\mu$m from the plate material 209 at times other than the time of plotting images. The contacting and releasing action may be composed of a slide type or may move like a pendulum by fixing the discharge head 122 by an arm that is fixed at a certain axis, and moving the arm around the axis. By causing the discharge head 122 to retreat when not plotting images, it is possible to prevent the discharge head 122 from physical breakage or being stained, and longer service life can be brought about.

In addition, the formed oil-based ink images are intensified by the fixation unit 205. Fixation unit that are publicly known, such as heating fixation, solvent fixation, etc., may be used. With respect to the heating fixation, irradiation of an infrared ray lamp, halogen lamp, xenon flash lamp, etc., or hot air fixation using a heater, or heat roll fixation is general. Flash fixation using a xenon lamp, etc., is publicly known as a fixation method of an electro-photography toner. It is advantageous in that fixation can be carried out in a short time. Also, where a paper plate is used, moisture contained in the paper is evaporated by a radical temperature rise, blister is produced, by which projections and recesses are generated on the surface of paper. Therefore, a plurality of fixation units are disposed, and power supply level and/or distance from the fixation unit to plate material 209 are varied so that the paper plate temperature gradually rises, This is favorable in view of preventing the blister on plate material 209.

In the case of solvent fixation, a solvent such as methanol, ethyl acetate, etc., which can dissolve resin constituents in ink, is sprayed or vapor thereof is provided to a plate material, and surplus solvent vapor is collected.

Also, at least in a process from formation of oil-based ink images by the discharge head 122 to fixation made by the fixation unit 205, it is preferable that images on the plate material 209 are maintained with nothing brought into contact therewith.

The obtained printing plate is used to print by a publicly known offset printing method. That is, a printing plate on which the oil-based ink images are formed is attached to an offset printing press. Printing ink and dampening water are provided thereto to form printing ink images, which are transferred onto a blanket cylinder rotating together with the plate cylinder. Next, the printing ink images existing on the blanket cylinder are transferred onto printing paper passing between the blanket cylinder and the impression cylinder, wherein printing per color is carried out. The printing plate by which printing has been completed is removed from the plate cylinder, and the blanket images of the blanket cylinder are cleaned off by a blanket cleaning unit. Then, the next printable status is thus brought about.

Hereinafter, a detailed description is given of embodiments of the invention.

The present invention is featured in that before and/or during forming images on a plate material (printing master plate) attached on a plate cylinder of a press by an ink jet method by which oil-based ink is discharged from a recording head by using electrostatic fields, an adhesive roller is caused to roll on the plate material to adsorb and remove dust and foreign matter existing on the plate material.

The ink jet method according to the invention is described in PCT WO93/11866 Specification. In the ink jet method, ink having high resistance is used, in which hydrophobic resin droplets, which are solid at least at a normal temperature, are dispersed in an insulative solvent. By actuating an intensive electric field onto the ink at a discharge position, the aggregate of resin droplets is formed at the discharged position, and the aggregate is discharged from the discharge position by the electrostatic unit. Thus, resin droplets are discharge as an aggregate which is highly concentrated, and a sufficient film thickness of printed dots can be obtained. Thereby, images of aggregated resin droplets having a sufficient print resistance property are formed on a plate material that is a recording medium.

In addition, in the ink jet method, the size of the discharged ink drops is determined by a size of the tip end portion of the discharge electrode or conditions of the electric field profile, and small ink drops can be obtained without making the diameter of an ink nozzle or slit width. And, it is possible to control the dot diameter on a plate material by controlling the conditions of the electric field profile.

Therefore, according to a offset printing method of the invention, it becomes possible to control minute images having print resistance without any problem of clogging of the head due to ink, and it becomes possible to print a great number of printed matter of clear images.

One construction example of an in-press image plotting and offset printing press, which is used to carry out the offset printing method according to the invention, is described below.

Figure 19:
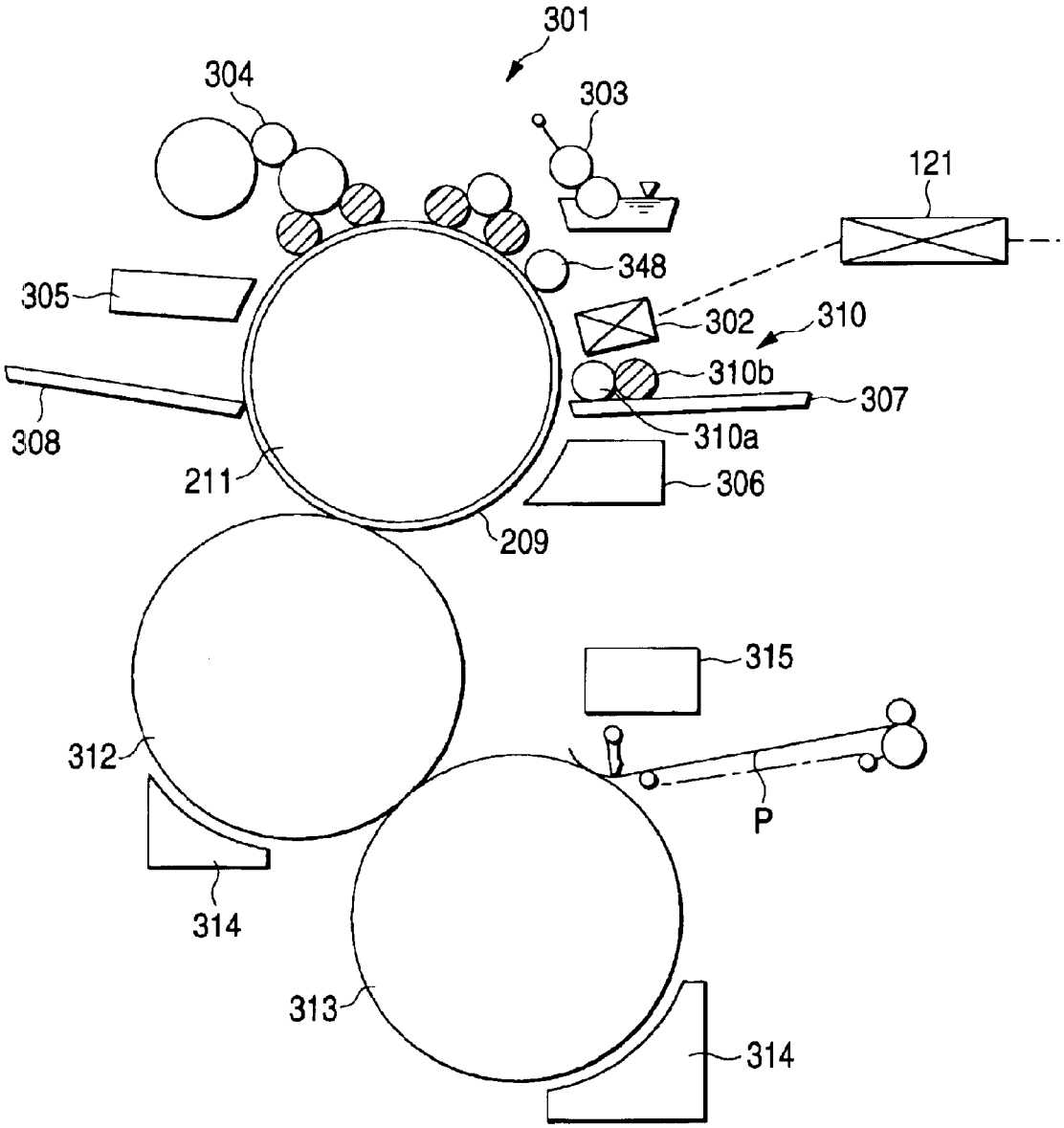
FIG. 19 is an exemplary view showing the entire construction of one example of an in-press image plotting and offset printing press according to the invention; and, FIG. 20 is an exemplary view showing the entire construction of an in-press image plotting and four-color single-side offset printing press, which is one example of a multi-color printing press used in the invention.
Figure 20:
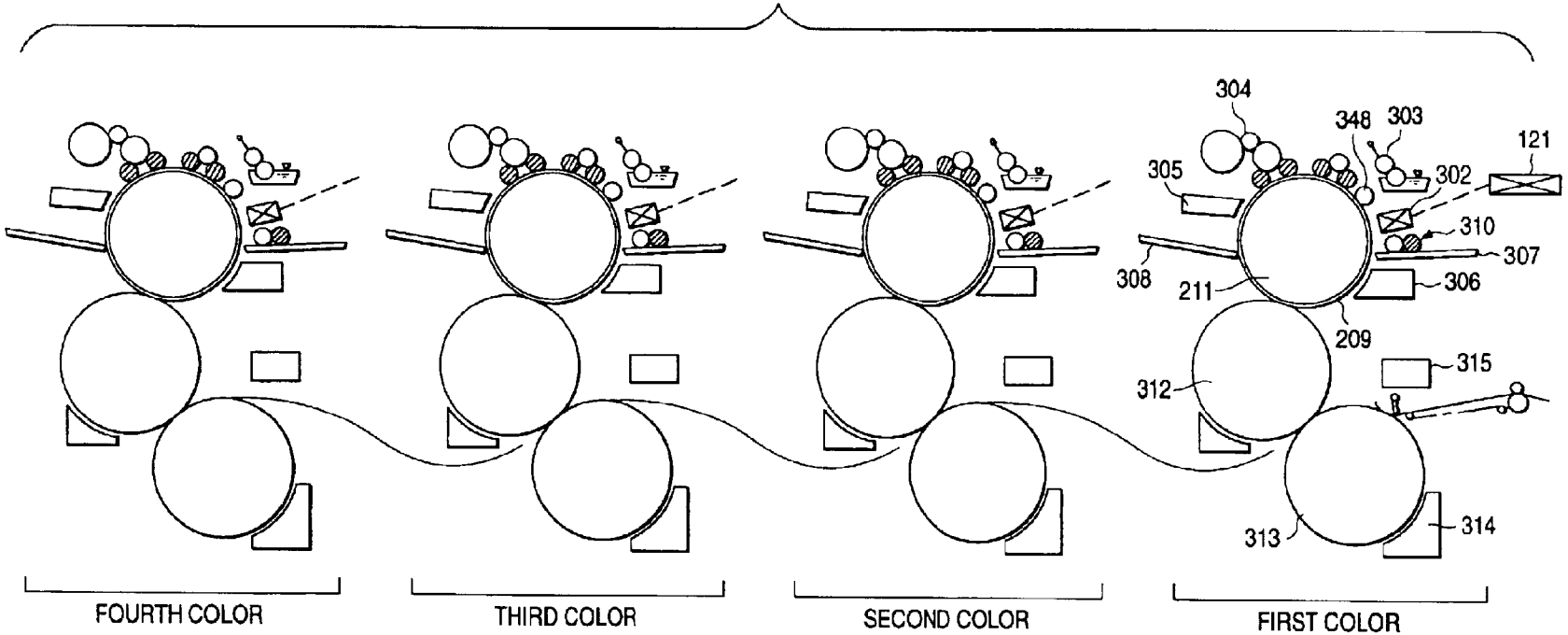

FIG. 19 is a general constructional view of an in-press image plotting and mono-color single-side offset printing press. FIG. 9 is a general constructional view of an image plotting portion including a control portion, an ink feeding portion, and a head contacting and releasing mechanism of the in-press image plotting and offset printing press. Also, FIG. 10 through FIG. 16 are to describe an ink jet recording unit with which the in-press image plotting and offset printing press shown in FIG. 19 and FIG. 20 is provided. Further, FIG. 20 shows a total constructional view of an in-press image plotting four-color single-side offset printing press according to the invention.

First, using the total constructional view of an in-press image plotting mono-color single-side offset printing press shown in FIG. 19, a description is given of a printing process which is carried out by the invention. As shown in FIG. 19, the in-press image plotting offset and printing press 301 (hereinafter called a "printing press") includes one plate cylinder 211, one blanket cylinder 312 and one impression cylinder 313. At least when carrying out offset printing, the blanket cylinder 312 for image transfer is disposed so as to be brought into contact with the plate cylinder 211, and the impression cylinder 313 is disposed so as to be brought into contact with the blanket cylinder 312 in order to transfer printing ink images, which are transferred thereto, onto printing paper P.

The plate cylinder 211 is usually made of metal, and the surface thereof is coated with, for example, chrome plating in order to intensify wearing resistance. However, as described later, the plate cylinder 211 may have a heat insulating material on the surface thereof. On the other hand, it is preferable that, since the plate cylinder 211 is made into an opposed electrode of the discharge head electrode in the electrostatic field discharge, it is grounded. Also, where the insulation of the matrix of the plate cylinder is high, it is preferable that a conductive layer is provided on the matrix. In this case, it is preferable that the conductive layer is grounded to the plate cylinder. Further, where a heat insulating material is provided on the plate cylinder as described above, the plotion will be facilitated by providing unit for grounding from the plate cylinder. In this case, conventional unit such as a brush, a plate spring, a roller, etc., each of which has conductivity, may be used.

In addition, the printing press 301 has an ink jet recording unit (ink jet image plotting unit) 302, wherein oil-based ink is discharged onto the plate material 209 attached to the plate cylinder 211 on the base of image data that are sent from the image data calculation controlling portion 121, and images are formed.

Also, a dampening water feeding unit 303 that feeds dampening water to the hydrophilic portion (non-imaging portion) on the plate material 209 is provided in the printing press 301. FIG. 19 shows a unit of the molton feeding system that is a representative example of the dampening water feeding unit 303. However, publicly known units such as a synchronous flow feeding system, a continuous water feeding system, etc., may be used in addition thereto as the dampening water feeding unit 303.

Further, the printing press 301 has a printing ink feeding unit 304 and a fixation unit 305 for intensifying oil-based ink images that are plotted on the plate material 209. Also, a plate surface desensitizing unit 306 may be provided to intensify the hydrophilicity of the surface of the plate material 209.

And, in the printing press 301, an adhesive roller 310 to adsorb and remove dust and foreign matter existing on the plate material is disposed so as to roll with respect to the plate material at the upstream side in the moving direction of the plate material of the ink jet recording unit 302. Also, herein, "roll" unit that the adhesive roller 310 is brought into contact with the plate material and moves relative to the plate material while rotating (including driven rotation and self-revolution). In the construction of the embodiment, since the adhesive roller 310 rotates at a fixed position with respect to a rotating plate material, relative movement can be brought about between the adhesive roller 310 and the plate material.

The adhesive roller 310 has freedom in being brought into contact with and releasing from the plate material by a contacting and releasing mechanism (not illustrated). The adhesive roller 310 removes dust and foreign matter existing on the plate material before and/or during plotting images on the plate material. That is, dust and foreign matter may be removed from the plate material either before plotting images, during plotting the same or before and during plotting the same. The adhesive roller 310 may be formed so that an adhesive layer is coated on the outer circumference of a cylindrical core material made of, for example, metal. For example, an adhesive rubber-based adhesion agent, acrylate-based adhesion agent, etc., may be listed as the adhesive layer. It is preferable that the adhesive roller 310 has an adhesive force of 4 hPa or more but 250 hPa of less, which is regulated by a method in compliance with [Test sample in which two parallel metallic plates are adhered together by rubber] in the article [Adhesion test between metal and vulcanized rubber] in Japanese Industrial Standard (JIS)-K6301 "Method for physical test of vulcanized rubber". However, further preferably, the adhesive force may be 7 hPa or more but 180 hPa or less. As in the results of the adhesive force of an adhesive roller and performance evaluation shown in Table 2, it is almost impossible to remove dust and foreign matter, wherein the roller cannot be used as the adhesive roller. Although an effect of removing dust and foreign matter is observed in the case of 4 hPa or more, the effect will be made further favorable in the case of 7 hPa or more. Also, where an adhesive roller whose adhesive force is 250 hPa or more, problems arise in that additional stains will be brought about in printing, and the print resistance will be lowered. In the case of250 hPa or less, the adhesive roller may be used. However, if the adhesive force is 180 hPa or less, no above-described problems occur, wherein the printing quality level will be made further favorable.

TABLE 2

| Adhesive force [hPa] | Removal of dust and foreign matter | Performance (or stain) in printing |
|---|---|---|
| 3 | X | ○ |
| 4 | Δ | ○ |
| 7 | ○ | ○ |
| 180 | ○ | ○ |
| 250 | ○ | Δ |
| 300 | ○ | X |

Since the adhesive roller 310 is caused to roll on a plate material and adsorbs and removes dust and foreign matter existing on the plate material, unnecessary ink is effectively prevented from being adhered on to the plate material along with dust and foreign matter placed between the head and the plate material during a plate making, wherein a satisfactory plate can be obtained. In addition, the recording head can be prevented from malfunctioning due to adhesion of dust and foreign matter on the plate material to the recording head when forming images. A malfunction of the recording head may be "clogged due to ink", for example. Further, it is possible to prevent images from becoming defective due to adhesion of ink onto dust and foreign matter existing on the plate material. Such defective images may be a projection and a recess on the image surface due to adhesion of ink onto dust and foreign matter and skipping of a color due to peeling-off of ink-adhered dust and foreign matter.

Furthermore, an automatic master plate feeding unit 307 that automatically feeds a plate material 209 onto the plate cylinder 311, and an automatic master plate delivery unit 308 that automatically removes the plate material 209 after printing is completed, may be provided. Hamada VS34A and B452A (HAMADA PRINTING PRESS CO, LTD), Toko 8000PFA (Tokyo Aircraft Instrument Co.,Ltd.), Ryobi 3200ACD, 3200PFA (Ryobi Imagix Co., Ltd.), AMSIS Multi 5150 FA (AM Japan Co., Ltd.), Oliver 266 EPZ (Sakurai Graphic Systems, Ltd), Shinohara 66IV/IVP (Shinohara Shoji, CO., Ltd.) are available as printing presses having such equipment that is publicly known as auxiliary equipment of the printing press. Further, a blanket cleaning unit 314 and an impression cylinder cleaning unit 314' may be installed therein. By employing these units 307, 308, 314 and 314', the printing operation can be further simplified. Also, since the printing time can be shortened, effects of the invention can be further increased. In addition, a unit 315 for preventing paper chips from being generated (Paper chip removing unit) may be provided in the vicinity of the impression cylinder 313, wherein it is possible to prevent paper chips from adhering onto a plate material. Methods based on humidity control, or absorption of air or by an electrostatic force may be employed as the paper chip generation preventing unit 315.

In addition, the printing press 301 includes a press roller 348 at the downstream side in the moving direction of a plate material of the ink jet recording unit 302. The press roller 348 is a roller whose surface is coated with Teflon, and is disposed to be controllable either in a pressed state or in a non-pressed state with respect to the plate cylinder 211 at the downstream side of the ink jet recording unit 302. Also, the press roller 348 has an adhesive layer coated on its outer circumference, and may be caused to have an adhesive force as in the above-described adhesive roller 310. Therefore, with such a construction, the adhesive roller 310 and press roller 348 cooperates with each other to adsorb and remove dust and foreign matter existing on the plate material, wherein performance for removing dust and foreign matter can be increased with no additional adhesive roller 310 provided. In addition, where the press roller 348 is made into an adhesive roller, and a sufficient effect of removing dust and foreign matter is obtained, only the press roller 348 that also acts as the adhesive roller may be used, instead of the above-described adhesive roller 310.

An image data calculation controlling portion 121 receives image data from an image scanner, a magnetic disk unit, an image data transmitting unit, etc., and decomposes colors. Further, the image data calculation controlling portion 121 calculates and divides the decomposed data into an adequate number of pixels and an adequate number of graduations. Further, since an oil-based ink image is made into dots for half tones and plotted by using the ink jet discharge head 122 (See FIG. 9. The head will be described later in detail.), which acts as a recording head which the ink jet recording unit 302 has, the image data calculation controlling portion 121 also calculates the dot area ratios.

Also, as described later, the image data calculation controlling portion 121 controls the movement of the ink jet discharge head 122 and discharge timing of oil-based ink, and simultaneously, the portion 121 controls the operation timing of the plate cylinder 211, blanket cylinder 312 and impression cylinder 313, etc., as necessary.

With reference to FIG. 19 and a part of FIG. 9, a description is given below of a process for preparing a master plate by using the printing press 301.

First, a plate material 209 is attached to the plate cylinder 211 by using an automatic master plate feeding unit 307. At this time, the plate material is adhered to and fixed on the plate cylinder by a mechanical method such as a publicly known plate top and tail gripper unit, air suction unit, etc., or also a publicly known electrostatic method, etc., whereby it is possible to prevent the plate material from being brought into contact with the ink jet recording unit 302 when plotting images and being damaged or broken due to flapping of the plate tail. In addition, unit for adhering the plate material to the plate cylinder only around the image plotting position of the ink jet recording unit is provided, and the unit is actuated at least when plotting images, whereby it is possible to prevent the plate material from being brought into contact with the ink jet recording head. Also, as shown in FIG. 19, although the press roller 348 is disposed at the downstream side in the moving direction of the plate material at the image plotting position of the plate cylinder, it may be disposed at the upstream side in the moving direction thereof.

Also, by providing unit for preventing the plate tail from being brought into contact with an ink feeding roller in the process of fixing a plate, it is possible to lessen stains that may occur on the plate surface. In detail, a press roller, a guide or electrostatic adsorption, etc., bring about such effects.

Image data from a magnetic disk unit, etc., are provided to the image data calculation controlling portion 121, and the image data calculation controlling portion 121 calculates a discharge position of oil-based ink in response to input image data and a dot area ratio at the position, These calculation data are once stored in a buffer. The image data calculation controlling portion 121 rotates the plate cylinder 211 and approaches the discharge head 122 to a position which is close to the plate cylinder 211 by a head contacting and releasing unit (recording head contacting and releasing unit) 331. The distance between the discharge head 122 and the surface of the plate material 209 on the plate cylinder 211 is maintained at an appointed distance during plotting images by a mechanical distance control such as a fitting roller or controlling the head contacting and releasing unit based on signals from an optical distance detector. With the distance control, the dot diameter can be prevented from being made uneven due to floating of the plate material or from being changed especially when a vibration is applied to a press, wherein satisfactory plates can be brought about.

A single channel head, a multi-channel head, or a full-line head may be used as the discharge head 122. Main scanning is carried out by rotations of the plate cylinder 211. In the case of the multi-channel head or full-line head having a plurality of discharge portions, the array direction of the discharge portions is determined in the axial direction. Further, in the case of the single channel head or multi-channel head, the head 322 is moved in the axial direction of the plate cylinder 211 per rotation of the plate cylinder 211 by the image data calculation controlling portion 121, and oil-based ink is discharged onto the plate material 209 attached to the plate cylinder 211 at the discharge position and dot area ratio, which are obtained by the above-described calculations. Thereby, dotted images are plotted on the plate material 209 with oil-based ink in response to shading of a printing document. This operation is continued until an oil-based ink image corresponding to one color of the printing document is formed on the plate material 209.

On the other hand, in the case where the discharge head 122 is a full-line head having roughly the same length as the width of the plate cylinder, an oil-based ink image equivalent to one color of the printing document is formed on the plate material 209 by one rotation of the plate cylinder, and a master plate is thus produced. By thus carrying out main scanning by revolutions of the plate cylinder, position accuracy in the main scanning direction can be increased, and images can be plotted at a high speed.

Next, in order to protect the discharge head 122, the discharge head 122 is retreated so as to be kept away from the position being approached to the plate cylinder 211. At this time, only the discharge head 122 may be retreated. However, the discharge head 122 and the head subscanning unit 332 may be retreated altogether, or the discharge head 122, ink feeding portion 324 and head subscanning unit 332 may be retreated altogether. Contacting and releasing unit is provided for each of the fixation unit 305 and adhesive roller 310 as in the discharge head 122, ink feeding portion 324, and head subscanning unit 332, these are constructed so as to be retreated, wherein these are applicable to normal printing.

Further, the formed oil-based ink image is intensified through heating by the fixation unit 305. Publicly known unit such as heating fixation and solvent fixation, etc., may be used as fixation unit of ink. Hot air or heat roll fixation utilizing irradiation of an infrared ray lamp, a halogen lamp, Xenon flash lamp, or a heater are commonly employed as heating fixation. In this case, in order to increase a fixation property, various unit such as heating of the plate cylinder, preheating of the plate material, plotting of images while applying hot air thereto, coating of the plate cylinder with a heat insulating material, heating of only the plate material with the plate material released from the plate cylinder when fixing, etc., may be effectively employed individually or in combination thereof. Flash fixation using a xenon lamp, etc., is publicly known as a fixation method for electrophotography toner, and is advantageous in view of shortening the fixation time. As regards solvent fixation, a solvent to dissolve resin constituents existing in ink such as methanol, ethyl acetate, etc., is jetted and sprayed, and surplus solvent vapor is collected.

Also, at least in a process from formation of oil-based ink images by the discharge head 122 to fixation made by the fixation unit 305, it is preferable that the dampening water feeding unit 303, printing ink feeding unit 304, and blanket cylinder 312 are maintained so as not to be brought into contact with the plate material 209 on the plate cylinder 211.

A printing process after a master plate is formed is similar to a publicly known offset printing method. That is, printing ink and dampening water are provided onto a plate material 209 on which the oil-based ink image was plotted, thereby forming a printing image, and the printing image is transferred onto the blanket cylinder 312 that rotates along with the plate cylinder 211. Next, the printing ink image existing on the blanket cylinder 312 is transferred onto printing paper P passing between the blanket cylinder 312 and the impression cylinder 313, wherein printing equivalent to one color is completed. After the printing is completed, the plate material 209 is removed from the plate cylinder 211 by the automatic master plate delivery unit 308, and the blanket of the blanket cylinder 312 is cleaned by the blanket cleaning unit 314, wherein the printing press is entered into the next printable state.

Next, a detailed description is given of the ink jet recording unit 302.

As shown in FIG. 9, the image plotting portion used for the present offset press is comprised of an ink jet recording unit 302 and an ink feeding portion 324. The ink feeding portion 324 further includes a tank 325, an ink feeding unit 126, and ink concentration controlling unit 129. The ink tank 125 is internally provided with ink agitating unit 127 and ink temperature managing unit (ink temperature controlling unit) 128. Ink may be circulated in the head. In this case, the ink feeding portion includes ink collection and circulation features. The ink agitating unit 327 suppresses sedimentation and coagulation of solid constituents of ink, wherein the necessity of cleaning the ink tank can be lessened. A rotary impeller, ultrasonic wave vibrator, and circulation pump may be used as the ink agitating unit. These may be used individually or in combination thereof. The ink temperature managing unit 328 is disposed so that high-quality images can be formed in a stabilized state without dot diameter being changed due to a change in the physical properties of ink depending on a change in the ambient temperature. Heat emitting elements such as a heater, Peltier elements, etc., or cooling elements are disposed in the ink tank, as the ink temperature managing unit, along with the agitating unit so that the temperature distribution in the corresponding tank is made uniform, wherein a publicly known method for controlling the temperature by a temperature sensor such as, for example, a thermostat, etc., may be used. The ink temperature in the ink tank is preferably 15° C. or higher but 60° C. or lower, further preferably, 20° C. or higher but 50° C. or lower. Also, the above-described ink agitating unit for preventing solid constituents of the ink from sedimentation or coagulation may be concurrently used as the agitating unit for keeping the temperature distribution uniform in the ink tank.

Further, the printing press includes ink concentration controlling unit 129 to carry out plotting of high-quality images. With the ink concentration controlling unit 129, it is possible to prevent blurs or skipping of printed images from occurring on the plate due to a lowering in the solid content concentration of the ink, or to effectively prevent the dot diameter on the plate from changing due to an increase in the solid content concentration. The ink concentration is controlled by physical measurement such as optical detection, measurement of electric conductivity, measurement of viscosity, etc., or by the number of images plotted. Where the ink concentration is controlled by measurement of physical properties thereof, an optical detector, a conductivity measurement instrument, a viscosity measurement instrument, etc., may be provided individually or in combinations thereof in the ink tank or in an ink flow channel, and output signals therefrom are used to control the ink concentration. In addition, where the ink concentration is controlled by the number of images plotted, ink liquid is supplied from a supplement concentrating ink tank or a diluting ink carrier tank, which are not illustrated, into the ink tank on the basis of the number of sheets printed, or frequency.

As described above, the image data calculation controlling portion 121 picks up timing pulses from an encoder 130 installed at the plate cylinder in addition to calculation of input image data and movement of the head by the head contacting and releasing unit 131 or the head subscanning unit 132, and drives the head in compliance with the timing pulses, whereby the positional accuracy in the subscanning direction can be increased. Also, when carrying out image depiction by the ink jet-recording unit, the plate is driven by using highly accurate drive unit that is different from the drive unit for printing, the positional accuracy in the subscanning direction can be also increased. At this time, it is preferable that only the plate cylinder is driven in a state where the plate cylinder is mechanically separated from the blanket cylinder, impression cylinder, and others. In detail, for example, a method in which output from a highly accurate motor is speed-reduced by highly accurate gears or a steel belt, etc., and only the plate cylinder is driven is available. When carrying out high-quality image depiction, these unit may be used individually or in combinations thereof.

Next, a description is given of an in-press image plotting and multi-color single-side offset printing press, which is a detailed example of the invention.

FIG. 20 is a general constructional example of the in-press image plotting and multi-color single-side offset printing press. As shown in FIG. 20, the corresponding in-press image plotting and multi-color single-side offset printing press basically has a structure including four sets of the plate cylinder 211, blanket cylinder 312 and impression cylinder 313 of the mono-color single-side printing press shown in FIG. 20, and these cylinders are disposed so that printing is carried out on the same side of printing paper P. Also, although not illustrated, printing paper that is shown with K in the drawing is transferred by a publicly known transfer cylinder system between adjacent impression cylinders. Although a detailed description is omitted, as has been easily understood in the example of FIG. 20, other multi-color single-side printing presses basically have a structure including a plurality of sets of the plate cylinder 211, blanket cylinder 312, and impression cylinder 313 of the mono-color single-side printing press, and these cylinders are disposed so that printing is carried out on the same side of printing paper P. Where a plate corresponding to one color is formed on the plate cylinder, the number of plate cylinders and blanket cylinders becomes equivalent to the number of printing colors. (Such a printing press is called a "unit type printing press"). On the other hand, where the present invention is embodied in a common impression cylinder type printing press having a single impression cylinder having a diameter, which is larger by integral number times than the diameter of the plate cylinder, with respect to plate cylinders and blanket cylinders corresponding to a plurality of colors, the printing press may have a structure for plate cylinders and blanket cylinders corresponding to the number of printing colors to commonly include a single impression cylinder, or may have a plurality of structures for plate cylinders and blanket cylinders corresponding to a plurality of colors to commonly include a single impression cylinder, in which the total number of plate cylinders and blanket cylinders is equivalent to the number of printing colors. In this case, printing paper is transferred by the above-described publicly known transfer cylinder system, etc., between the common impression cylinders adjacent to each other.

On the other hand, where plates covering a plurality of colors are formed on the plate cylinder, plate cylinders and blanket cylinders equivalent to the number that is obtained by dividing the number of colors to be printed by the number of plates on one plate cylinder are required. For example, where plate materials equivalent to two colors are formed on the plate cylinders, single-side four color printing is enabled by a printing press having two plate cylinders and two blanket cylinders. In this case, the impression cylinder diameter is made the same as that of the plate cylinder, which is equivalent to one color, and unit for retaining printing paper until printing an equivalent to the necessary number of colors is completed is provided on the impression cylinder as necessary. A publicly known transfer cylinder system is employed to transfer printing paper between impression cylinders. In the case of a printing press having two plate cylinders, on which plates equivalent to the above-described two colors are formed, and two blanket cylinders, one plate cylinder retains printing paper and rotates two times, whereby two-color printing is carried out. Next, printing paper is transferred between impression cylinders. Next, the other impression cylinder holds the printing paper and rotates two times, wherein two-color printing is further carried out, and four-color printing is completed. Also, although the number of impression cylinders may be equivalent to the number of plate cylinders, it may be acceptable that several plate cylinders and blanket cylinders hold one impression cylinder.

On the other hand, where the invention is carried out as an in-press image-plotting and multi-color double-side sheet-fed offset printing press, either a structure in which publicly known printing paper reversing unit is provided for at least one between the adjacent impression cylinders, of the above-described unit type printing press, a structure in which a plurality of the above-described common impression type printing presses are disposed, and publicly known printing paper reversing unit is provided for at least one between the adjacent impression cylinders, or a structure in which a plurality of plate cylinders 311 and blanket cylinders 312, each of which is used for the mono-color single-side printing press shown in FIG. 19, are disposed so that printing is carried out on both sides of printing paper P, is employed. In the structure shown in FIG. 19, where a plate equivalent to one color is formed on a plate cylinder, the structure requires plate cylinders and blanket cylinders equivalent to the number of colors necessary to print on both sides of printing paper P. On the other hand, where plates equivalent to a plurality of colors are formed on plate cylinders as described above, the number of plate cylinders, blanket cylinders and impression cylinders may be decreased. Also, where several plate cylinders and blanket cylinders commonly have a single impression cylinder, the number of impression cylinders can be further decreased. Unit for retaining printing paper until printing an equivalent to the necessary number of colors is completed is provided on the impression cylinder as necessary. A detailed description thereof is omitted since it can be easily understood on the basis of the example of the above-described in-press image plotting and multi-color single-side offset printing press.

The above description was given of a sheet-fed printing press as an embodiment of the in-press image plotting and multi-color offset printing press according to the invention. On the other hand, in a case where the invention is carried out as an in-press image plotting and multi-color web (winding paper) offset printing press, the above-described unit type and common impression cylinder type can be preferably used. Also, where the invention is carried out as an in-press image plotting and multi-color web double-side offset printing press, in both the unit type and common impression cylinder type, an embodiment can be achieved by a structure in which publicly known web reversing unit is provided for at least one between the adjacent impression cylinders, or a structure in which a plurality of unit are provided so that printing can be carried out on both sides of printing paper P. Also, a BB type (that is, a blanket-to-blanket type) is most preferable as the in-press image-plotting and multi-color double-side web offset printing press. This is achieved by the following structures equivalent to the number of colors to be printed, in each of which a plate cylinder and a blanket cylinder (with no impression cylinder provided) equivalent to one color to print on one side of the web, and a plate cylinder and a blanket cylinder (with no impression cylinder provided) equivalent to one color to print on the other side of the web are brought into contact with each other when printing is executed, and the web is caused to pass between the blanket cylinders brought into contact with each other when printing, wherein multi-color double-side printing is enabled.

Another example of the in-press image plotting and offset printing press has two plate cylinders per blanket cylinder, wherein while printing is carried out by a one plate cylinder, an image is plotted by the other plate cylinder. In this case, it is preferable that the drive of the plate cylinder that carries out image depiction is mechanically independent from the blanket cylinder, wherein image depiction is enabled without any pause of the printing press. Also, as has been easily understood, the present in-press image depiction and offset printing press is applicable to an in-press image plotting and multi-color single-side offset printing press and an in-press image plotting and multi-color double-side offset printing press.

Next, a description is given of a plate material (master plate) used for the invention.

A metal plate such as a steel plate, etc., on which aluminum or chrome is plated may be listed as a master plate. In particular, an aluminum plate is preferably employed, whose surface is superior in water retentivity and wear resistance by sand dressing and anode oxidation treatment. As inexpensive plate materials, plate materials that are produced by applying an image receiving layer on a waterproof carrier matrix such as watertight paper, other paper on which a plastic film plastic is laminated, etc., may be used. It is adequate that the image receiving layer provided is 5 through 30 $\mu$m.

A hydrophilic layer composed of an inorganic pigment and a binder or a layer that is made hydrophilic by a desensitizing process may be used as the image receiving layer.

Clay, silica, calcium carbonate, zinc oxide, aluminum oxide, barium sulfate, etc., may be used as inorganic pigments used for the hydrophilic image receiving layer. Also, hydrophilic binders such as polyvinyl alcohol, starch, carboxymethyl cellulose, hydroxyethyl cellulose, casein, gelatin, polyacrylate, polyvinylpyrrolidone, polymethylether-maleic anhydride copolymer, etc., may be used as the binder. Melamine-formalin resin, urea-formalin resin, which provide watertightness, and other bridging agents may be added as necessary.

On the other hand, a layer using, for example, zinc oxide and a hydrophobic binder, may be listed as an image receiving layer which is used by a desensitizing treatment.

For example, as has been described in "New Edition, Bulletin of Pigments", Page 319, edited by Nippon Pigment Technology Association and published by Seibundo, Ltd. (1968), zinc oxide used for the invention may be either one of zinc oxide, zinc flowers, wet zinc flowers or active zinc flowers which are commercially available.

That is, zinc oxide has a variation, for example, of a French method (indirect method) as a dry method, an American method (direct method) and a wet method. Those which are produced by respective makers, for example, Seido Chemical, Ltd., Sakai Chemical, Ltd., Hakusui Chemical, Ltd., Honjyo Chemical, Ltd., Toho Zinc, Co., Ltd., Mitsui Kinzoku Kogyo Co., Ltd., may be listed.

In detail, styrene copolymer, methacrylate copolymer, acrylate copolymer, vinyl acetate copolymer, polyvinylbutyral, alkyd resin, epoxy resin, epoxyester resin, polyester resin, polyurethane resin, etc., may be used as resins as a binder. These resins may be used individually or in combination of two or more thereof.

It is preferable that the content ratio of resin in the image receiving layer is 9/91 through 20/80 in terms of weight ratio of resin/zinc oxide.

Zinc oxide is desensitized by a desensitization processing agent by the conventional method. Since previously, a cyan compound-contained processing solution mainly composed of ferrocyanate and ferricyanate, a cyan-free processing solution mainly composed of ammine cobalt complex, phytin acid, and its derivatives, guanidine derivatives, a processing solution mainly composed of an inorganic acid or organic acid that forms zinc ions and chelate, or a processing solution having water-soluble polymers have conventionally been known as such a type of desensitization processing solution.

For example, cyan compound-contained processing solutions that are described in, for example, Japanese Patent Publication Nos. 4-9045, 6-39403, Japanese Unexamined Patent Application Publications Nos. 52-76101, 57-107889 and 54-117201 are available.

Also, it is preferable that the opposed side of the image processing layer of a plate material is 150 through 700 (seconds/10 cc) in view of Beck smoothness, whereby the formed printing plate is made free from slipping and sliding on the plate cylinder during printing, and satisfactory printing can be carried out.

Herein, Beck smoothness can be measured by a Beck smoothness tester. The "Beck smoothness tester" is such that a test piece is pressed at a fixed pressure (1 kgf/cm$^2$ (9.8 N/cm$^2$)) onto a glass plate, having a hole at its center, which has been finished to be highly smooth, and the time required for a fixed amount (10 cc) of air to pass through the glass surface and the test plate under a reduced pressure is measured.

60 grams (as a solid amount) of resin droplets (PL-1), which were produced in Production Example 1 of resin droplets for ink, 2.5 grams of the above-described nigrosin dispersant, 15 grams of FOC-1400 (Nissan Chemical, Ltd., Tetradecylalcohol), and 0.08 grams of octene-half maleic acid hexadecylamide copolymer were diluted in one liter of Isobar-G, thereby producing black oil-based ink.

Next, two liters of the oil-based ink (IK-1), which was thus produced as described above, was filled in an ink tank an ink jet recording unit of an image plotting unit of a printing press shown in FIGS. 9 and 19. Herein, a full-line head of 900 dpi of such a type as shown in FIG. 10 was used as the recording head. A dump-in heater and impeller blades were provided in the ink tank as ink temperature controlling unit, and then the ink temperature was set to 30° C. And, the temperature was controlled by a thermostat while turning the impeller blades at 30 r.p.m. Herein, the impeller blades were used as agitating unit for preventing sedimentation and coagulation. Further, a part of the ink flow channel is made transparent, an LED, light emitting element, and an optical detection element were placed so as to place the part therebetween, wherein the concentration of the ink was controlled by adding a dilution liquid (Isobar-G) of ink or a concentration ink (in which the solid density of the above-described IK-1 ink was doubled) on the basis of the output signals thereof.

A paper plate material having a hydrophilic image receiving layer formed on its surface, which is shown below, was used as the plate material. Wood-free paper whose weight is 100 grams per square meter was used as a matrix, and after a dispersing liquid A adjusted as described below was dried on a paper carrier body for which a water-resisting layer mainly composed of kaolin, polyvinyl alcohol, SBR latex, and resin constituents of melamine resin is provided on the surface of the matrix, an image receiving layer is provided so that the coating amount thereof becomes 6 grams per square meter. Thus, the paper plate material was produced.

Dispersing liquid A

Gelatine (Wako Pure Chemical, 1st grade)

3 grams

Colloidal silica (Nissan Chemical, Ltd.

Snow tex C, 20% water dispersing liquid) 20 grams

Silica gel (Fuji Silysia Chemical, Ltd;

| | |
|---|---|
| Sylisia #310) | 7 grams |
| Hardening agent | 0.4 grams, and |
| Distilled water | 100 grams |

were dispersed along with glass beads by a paint shaker for ten minutes.

The above-described plate material was set on an automatic plate feeding unit, and the plate material was mechanically mounted on a plate cylinder. A dampening water feeding unit, printing ink feeding unit, and blanket cylinder are separated from the plate cylinder so that these are not brought into contact with the plate material. After dust and foreign matter existing on the surface of the plate material were removed by an adhesive roller, the discharge head was approached to the plate material so as to reach the image plotting position. Image data to be printed were transmitted to the image data calculation controlling portion, and a 64-channel discharge head was moved while turning the plate cylinder, wherein oil-based ink was discharged on the plate to form images. At this time, the tip end width of the discharge electrode of the ink jet head was set to 10 $\mu$m, and where the distance between the plate material and the plate cylinder, that is, floating is 0.1 mm or more, judging from an output of an optical gap detecting unit, a plate material printing roller (made of Teflon) was actuated before plotting images. Further, the distance between the head and the plate material was controlled so as to be 1 mm±0.03 mm at all times during plotting images. 2.5 kV voltage was constantly applied as a bias voltage, and 500V pulse voltage was further overlapped when carrying out discharge, wherein image depiction was carried out while changing the dot areas by changing the pulse voltage in a range of 256 steps between 0.2 milliseconds and 0.05 milliseconds.

In Embodiment 4, the adhesive force of the adhesive roller was set to 7 hPa or more but 180 hPa or less in the same conditions described above, in Embodiment 5, the adhesive force of the adhesive roller was set to 4 hPa or more but 7 hPa or less in the same conditions described above, and in Embodiment 6, the adhesive force of the adhesive roller was set to 180 hPa or more but 250 hPa or less in the same conditions described above. In addition, in Comparative Control 3, the adhesive force of the adhesive roller was set to 4 hPa or less, and in Comparative Control 4, the adhesive force of the adhesive roller was set to 250 hPa or more. According to the results thereof, in Embodiment 4, almost all dust and foreign matter can be adsorbed and removed by the adhesive roller, wherein no malfunction such as clogging of the recording head occurs, and clear images free from defects such as staining the printing could be obtained. Also, in Embodiment 5, only dust and foreign matter slightly remains on the plate material. However, the level is such that no problem is constituted. Also, in Embodiment 6, only slight printing stains were observed, and there is no problem in practical application.

To the contrary, in Comparative control 3, the adsorption force of dust and foreign matter is weak, wherein it is impossible to remove the dust and foreign matter. In addition, in Comparative Control 4, the hydrophilic surface of the plate material is impaired, and stains occurred when printing.

According to the invention, in a printing method for directly forming images on a printing medium and producing printed matter by fixing the images, an adhesive roller is caused to roll on the printing medium before forming images on the printing medium and/or during forming the images, and dust and foreign matter are absorbed and removed from the surface of the printing medium, wherein it is possible to prevent malfunctions due to dust or foreign matter on the printing medium being adhered to the discharge head when forming the images. Therefore, the recording head can be kept clean at all times, and a great number of printed matter having clear images can be printed. In addition, it is possible to prevent images from being skipped due to adhesion of ink onto dust and foreign matter on the printing medium. As a result, it is possible to bring about clear printed matter of high-quality images by an inexpensive apparatus and a simple method.

According to the invention, in a plate making method for directly forming images on a plate material and making a printing plate by fixing the images, since an adhesive roller was caused to roll on the plate material before and/or during forming images on the plate material in order to adsorb and remove dust and foreign matter existing on the surface of the plate material, it is possible to prevent a malfunction from occurring due to adhesion of dust and foreign matter existing on the plate material to the discharge head, wherein it is possible to produce a great number of high quality printed matter having clear images. Further, it is possible to prevent the images from skipping due to adhesion of ink to dust and foreign matter existing on the surface of a plate material. In addition, a high quality printing plate directly corresponding to digital image data can be constantly prepared, wherein inexpensive and high-speed offset printing is enabled.

According to the invention, since, before and/or during forming images on a plate material, the adhesive roller is caused to roll on the plate material and dust and foreign matter existing on the plate material are adsorbed and removed therefrom, it is possible to prevent the recording head from malfunctioning due to adhesion of dust and foreign matter existing on the plate material to the recording head, whereby it becomes possible to bring about a great number of printed matter including clear images. Also, it is possible to prevent the images from being skipped due to adhesion of ink to dust and foreign matter existing on the plate material. In addition, master plates corresponding to digital image data can be produced in a printing press at a high quality in a stabilized state, wherein it is possible to carry out inexpensive offset printing at a high speed.

What is claimed is:

1. An image forming method comprising steps of:

preparing a medium to be formed an image thereon, the image being based on signals of image data;

forming the image directly on the medium in an ink jet system that discharges oil-based ink by utilizing electrostatic fields;

rolling an adhesive roller on the medium before and/or during forming the image on the medium;

adhering dust existing on the medium to the adhesive roller in order to remove the dust from the medium; and, fixing the image on the medium, wherein an adhesive force of the adhesive roller is 4 hPa or more and 250 hPa or less.

2. An ink jet printing method to which the image forming method as set forth in claim 1 is applied, wherein the medium is a printing medium and a printed matter is created by forming and fixing the image directly on the printing medium.

3. A plate making method to which the image forming method as set forth in claim 1 is applied, wherein the medium is a plate material and a plate is created by forming and fixing the image directly on the plate material.

4. An in-press image plotting and offset printing method to which the plate making method as set forth in claim 3 is applied, further comprising steps of:

attaching the plate material onto a plate cylinder of a press; and carrying out continuously offset printing by using the plate, wherein the step of attaching the plate material is carried out before the step of forming the image on the plate material and the step of offset printing is carried out after the fixing the image.

5. The image forming method of claim 1, wherein the adhesive roller comprises a rubber-based adhesive agent.

6. The image forming method of claim 1, wherein the adhesive roller comprises an acrylate-based adhesive agent.

7. An image forming apparatus comprising:

an image forming unit, for forming an image which is on the basis of image data directly on a medium, discharging oil-based ink by utilizing electrostatic fields in an ink jet image plotting;

an image fixing unit fixing the image on the medium formed by the image forming unit; and an adhesive roller disposed so as to roll on the medium at an upstream of the image forming unit in a moving direction of the medium, wherein the adhesive roller adheres dust existing on the medium thereto in order to remove the dust from the mediums wherein an adhesive force of the adhesive roller is 4 hPa or more and 250 hPa or less.

8. The image forming apparatus as set forth in claim 7, wherein the adhesive roller includes at least two adhesive rollers whose adhesive forces are different from each other, one adhesive roller rolls on a medium, and simultaneously the other adhesive roller contacts with the one adhesive roller and has a larger adhesive force than that of the corresponding one adhesive roller.

9. An ink jet printing apparatus to which the image forming apparatus as set forth in claim 7 is applied, wherein the medium is a printing medium and a printed matter is created by forming the image directly on the printing medium.

10. A plate making apparatus to which the image forming apparatus as set forth in claim 7 is applied, wherein the medium is a plate material and a plate is created by forming the image directly on the plate material.

11. An in-press image plotting and offset printing apparatus to which the plate making apparatus as set forth in claim 10 is applied, further comprising:

a plate cylinder of a press attached a plate material thereon;

wherein offset printing is carried out continuously by using the plate.

12. An in-press image plotting and offset printing apparatus as set forth in claim 11, further comprising:

a press roller disposed at the downstream of the image fanning unit in a moving direction of the plate material in a state of either one of a pressed state or a non-pressed state with respect to the plate cylinder, wherein the press roller has the adhesive forces.

13. The image forming apparatus of claim 7, wherein the adhesive roller comprises a rubber-based adhesive agent.

14. The image forming apparatus of claim 7, wherein the adhesive roller comprises an acrylate-based adhesive agent.

* * * * *